US009207630B2

(12) United States Patent
Eto

(10) Patent No.: US 9,207,630 B2
(45) Date of Patent: Dec. 8, 2015

(54) IMAGE FORMING APPARATUS AND TONER CASE

(71) Applicant: KYOCERA Document Solutions Inc., Osaka (JP)

(72) Inventor: Daisuke Eto, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 14/279,874

(22) Filed: May 16, 2014

(65) Prior Publication Data

US 2014/0348533 A1 Nov. 27, 2014

(30) Foreign Application Priority Data

May 21, 2013 (JP) ..... 2013-106697

(51) Int. Cl.
*G03G 21/16* (2006.01)
*G03G 15/08* (2006.01)

(52) U.S. Cl.
CPC ..... *G03G 21/1652* (2013.01); *G03G 15/0863* (2013.01)

(58) Field of Classification Search
CPC ..... G03G 21/1652; G03G 21/1647; G03G 2221/166
See application file for complete search history.

(56) References Cited

U.S. PATENT DOCUMENTS 7,079,783 B2 7/2006 Yokoi
7,209,678 B2 4/2007 Yokoi
7,421,225 B2 9/2008 Yokoi
7,536,130 B2 5/2009 Yokoi
7,953,340 B2 * 5/2011 Tanabe et al. ..... 399/90
8,706,005 B2 4/2014 Okabe
2008/0310881 A1 * 12/2008 Sato ..... 399/111
2011/0129252 A1 * 6/2011 Oda et al. ..... 399/119

FOREIGN PATENT DOCUMENTS

JP H08-101619 A 4/1996
JP 2004-077565 A 3/2004
JP 2010-224483 A 10/2010
JP 2011-170130 A 9/2011

(Continued)

OTHER PUBLICATIONS

An Office Action; "Notice of Reasons for Rejection," issued by the Japanese Patent Office on Aug. 18, 2015, which corresponds to Japanese Patent Application No. 2013-106697 and is related to U.S. Appl. No. 14/279,874.

*Primary Examiner* — Sandra Brase
(74) *Attorney, Agent, or Firm* — Studebaker & Brackett PC

(57) ABSTRACT

An image forming apparatus includes an apparatus main body, a development device, and a toner case. The apparatus main body includes an image carrier and a main body side connecting part including a main body side connector and a main body side housing. The toner case includes a case side connecting part including a case side connector and a case side housing. The development device is movable in a first direction as an approach/separation direction to the image carrier in a situation in which the development device is installed to the apparatus main body. The case side housing fits to the main body side housing and a case side terminal comes into contact with a main body side terminal in a situation in which the development device is installed to the apparatus main body and the toner case is installed to the development device.

18 Claims, 23 Drawing Sheets

(56) References Cited

FOREIGN PATENT DOCUMENTS

| | | | |
|---|---|---|---|
| JP | 2012-226288 | A | 11/2012 |
| JP | 2012-234190 | A | 11/2012 |
| WO | 2011/155642 | A1 | 12/2011 |

* cited by examiner

IMAGE FORMING APPARATUS AND TONER CASE

INCORPORATION BY REFERENCE

This application is based on and claims the benefit of priority from Japanese Patent application No. 2013-106697 filed on May 21, 2013, the entire contents of which are incorporated herein by reference.

BACKGROUND

The present disclosure relates to an image forming apparatus and a toner case arranged in this image forming apparatus.

An electrographic image forming apparatus carries out developing process by supplying a toner (a developer) from a development device to an image carrier (for example, a photosensitive drum) carrying a toner image. The toner used for such a developing process is supplied from a toner case to the development device. In general, this toner case is attachably/detachably installed to the development device, for example, so as to be easily replaced when the internal toner is run out.

The above-mentioned toner case may be provided with a case side connector (an information chip) storing various information, such as a serial number. In such a case, an apparatus main body of the image forming apparatus is provided with a main body side connector. By carrying out communication between the main body side connector and case side connector, various information is read from the case side connector and various information is written to the case side connector.

As a communication manner between the main body side connector and case side connector, there are wireless communication and contact communication. In the wireless communication, a relatively expensive wireless communication board is needed, and then, a cost is increased. Therefore, the contact communication has an advantage of constructing the image forming apparatus at a lower cost than the wireless communication.

In the contact communication between the main body side connector and case side connector as mentioned above, in order to avoid communication failure, it is important to securely contact a case side terminal arranged in the case side connector to a main body side terminal arranged in the main body side connector whenever the toner case is attached to/detached from the development device. On the other hand, as mentioned above, the electrographic image forming apparatus carries out the developing process by supplying the toner from the development device to the image carrier. At this time, In order to supply a suitable amount of the toner from the development device to the image carrier, it is important to arrange the development device at a suitable position to the image carrier.

SUMMARY

In accordance with an embodiment of the present disclosure, an image forming apparatus includes an apparatus main body, a development device, and a toner case. The apparatus main body includes an image carrier and a main body side connecting part. The image carrier carries a toner image. The main body side connecting part includes a main body side connector and a main body side housing. The main body side connector has a main body side terminal. The main body side housing holds the main body side connector. The development device is attachably/detachably installed to the apparatus main body to supply a toner to the image carrier. The toner case is attachably/detachably installed to the development device to supply a toner to the development device. The toner case includes a case side connecting part. The case side connecting part includes a case side connector and a case side housing. The case side connector includes a case side terminal contactable with the main body side terminal. The case side housing holds the case side connector. The development device is configured to be movable in a first direction as an approach/separation direction to the image carrier in a situation in which the development device is installed to the apparatus main body. The case side housing fits to the main body side housing and the case side terminal comes into contact with the main body side terminal in a situation in which the development device is installed to the apparatus main body and the toner case is installed to the development device.

Moreover, in accordance with an embodiment of the present disclosure, a toner case is arranged to an image forming apparatus including an apparatus main body and a development device. The apparatus main body includes an image carrier and a main body side connecting part. The image carrier carries a toner image. The main body side connecting part includes a main body side connector and a main body side housing. The main body side connector has a main body side terminal. The main body side housing holds the main body side connector. The development device is attachably/detachably installed to the apparatus main body to supply a toner to the image carrier. The toner case is attachably/detachably installed to the development device to supply a toner to the development device. The toner case includes a case side connecting part. The case side connecting part includes a case side connector and a case side housing. The case side connector includes a case side terminal contactable with the main body side terminal. The case side housing holds the case side connector. The development device is configured to be movable in a first direction as an approach/separation direction to the image carrier in a situation in which the development device is installed to the apparatus main body. The case side housing fits to the main body side housing and the case side terminal comes into contact with the main body side terminal in a situation in which the development device is installed to the apparatus main body and the toner case is installed to the development device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
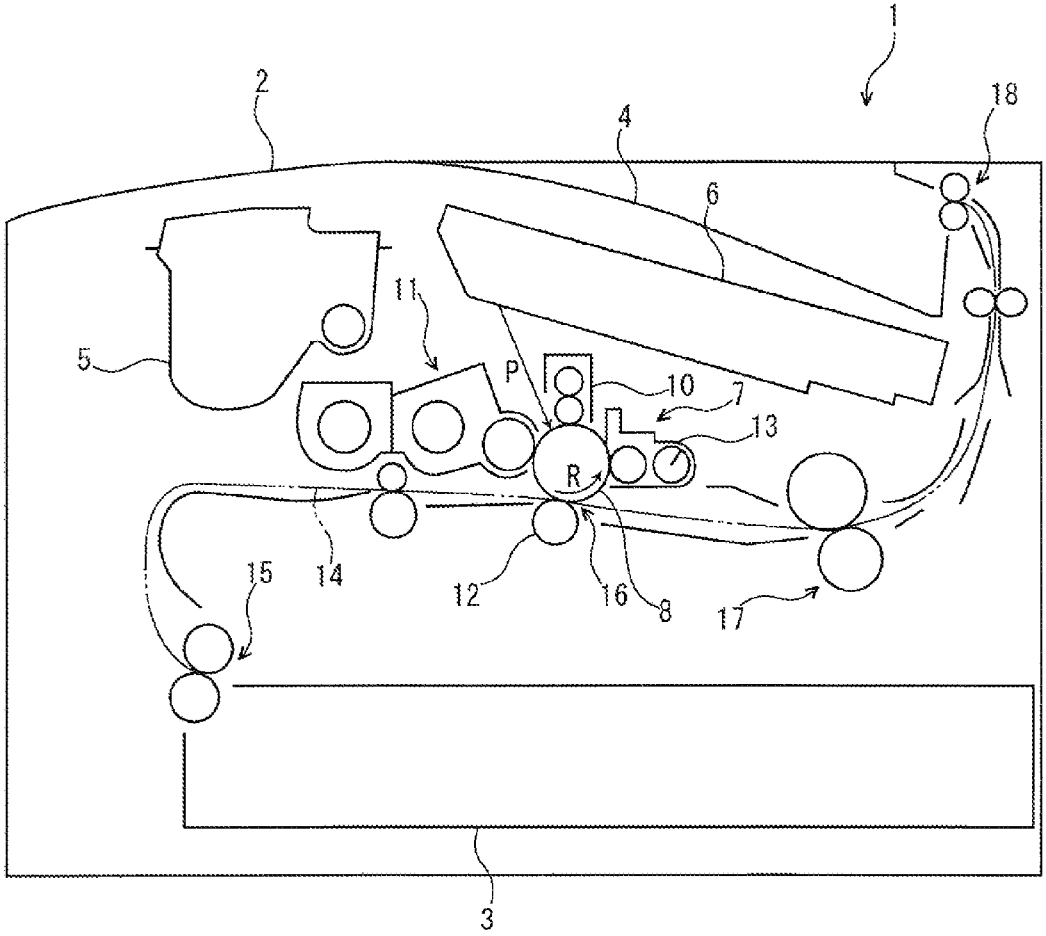
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a printer main body 2 (an apparatus main body). In a lower part of the printer main body 2, a sheet feeding cartridge 3 storing sheets (not shown) is installed and, in a top end of the printer main body 2, a sheet ejected tray 4 is formed.

In a left upper part of the printer main body 2, a toner container 5 (a toner case) is installed. In aright upper part of the printer main body 2, an exposure device 6 composed of a laser scanning unit (LSU) is located. In a middle part of the printer main body 2, an image forming part 7 is arranged. In the image forming part 7, a photosensitive drum 8 (an image carrier) is rotatably arranged. Around the photosensitive drum 8, a charger 10, a development device 11, a transfer roller 12 and a cleaning device 12 are located along a rotating direction (refer to an arrow R in FIG. 1) of the photosensitive drum 8.

Inside the printer main body 2, a conveying path 14 for the sheet is arranged. At an upstream end in the conveying path 14, a sheet feeder 15 is positioned. At an intermediate stream part in the conveying path 14, a transferring part 16 composed of the photosensitive drum 8 and transfer roller 12 is positioned. At a downstream part in the conveying path 14, a fixing device 17 is positioned. At a downstream end in the conveying path 14, a sheet ejecting part 18 is positioned.

Next, the operation of forming an image by the printer 1 having such a configuration will be described.

When the power is supplied to the printer 1, various parameters are initialized and initial determination, such as temperature determination of the fixing device 17, is carried out. Subsequently, in the printer 1, when image data is inputted and a printing start is directed from a computer or the like connected with the printer 1, image forming operation is carried out as follows.

First, the surface of the photosensitive drum 8 is electric-charged by the charger 10. Then, exposure corresponding to the image data on the photosensitive drum 8 is carried out by a laser light (refer to an arrow P in FIG. 1) from the exposure device 6, thereby forming an electrostatic latent image on the surface of the photosensitive drum 8. Subsequently, the development device 11 develops the electrostatic latent image by a toner (a developer) supplied from the toner container 5. Accordingly, a toner image is carried on the photosensitive drum 8.

On the other hand, a sheet fed from the sheet feeding cartridge 3 by the sheet feeder 15 is conveyed to the transferring part 16 in a suitable timing for the above-mentioned image forming operation, and then, the toner image carried on the photosensitive drum 8 is transferred onto the sheet in the transferring part 16. The sheet with the transferred toner image is conveyed to a downstream side in the conveying path 14 to go forward to the fixing device 17, and then, the toner image is fixed on the sheet in the fixing device 17. The sheet with the fixed toner image is ejected from the sheet ejecting part 18 to the sheet ejected tray 4. The toner remained on the photosensitive drum 8 is collected by the cleaning device 13.

Next, the printer main body 2, development device 11 and toner container 5 will be described in detail.

Arrows Fr suitably shown in the figures indicate the front side of the printer 1. Arrows X suitably shown in the figures indicate an attaching direction of the toner container 5 to the development device 11 (hereinafter, called as a "second direction X"). The second direction Xis a direction from the upper side to the lower side. Arrows Y suitably shown in the figures indicate an approach/separation direction of the development device 11 to the photosensitive drum 8 (hereinafter, called as a "first direction Y"). The first direction Y is left and right directions. Arrows Z suitably shown in the figures indicate a direction intersecting the second direction X and first direction Y (hereinafter, called as a "third direction Z"). The third direction Z is forward and backward directions.

First, the printer main body 2 will be described.

Figure 2:
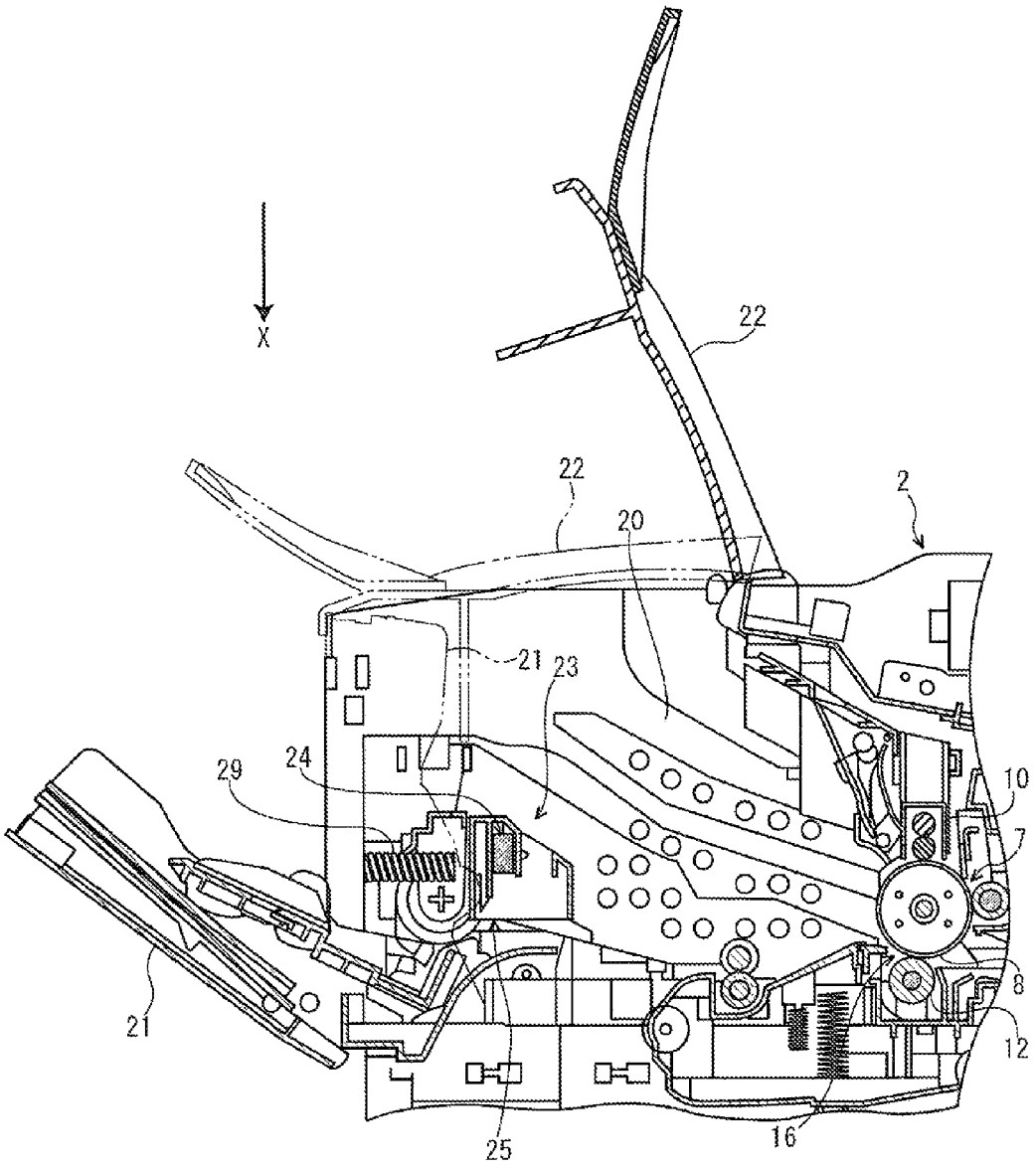
FIG. 2 is a sectional view showing a left upper part of a printer main body of the printer according to the first embodiment of the present disclosure.

As shown in FIG. 2, in a left side part of the printer main body 2, an installed part 20, to which the development device 11 is installed, is formed. At the right lower side of the installed part 20, the photosensitive drum 8 is rotatably arranged. A left side part of the photosensitive drum 8 faces to the installed part 20. To a left end part of the printer main body 2, an openable/closable manual bypass tray 21 is attached. In the left end part of the printer main body 2, a coil spring 29 (a biasing body) is installed. To the left upper part of the printer main body 2, an openable/closable upper cover 22 is attached. The upper cover 22 is omitted except for FIG. 2.

Figure 3:
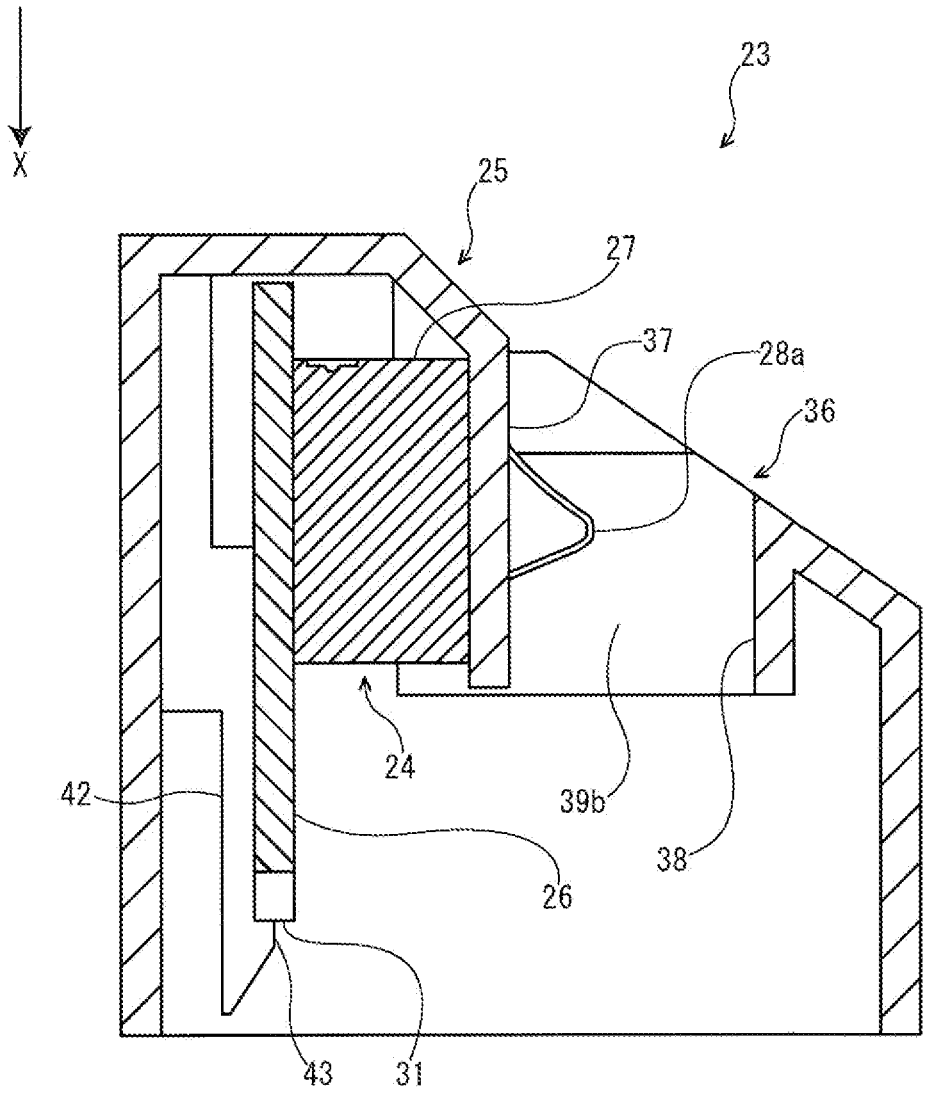
FIG. 3 is a sectional view showing a main body side connecting part in the printer main body of the printer according to the first embodiment of the present disclosure.

In a left lower part of the installed part 20 of the printer main body 2, a main body side connecting part 23 is arranged. As shown in FIG. 3, the main body side connecting part 23 includes a main body side connector 24 and a main body side housing 25 holding the main body side connector 24.

Figure 4:
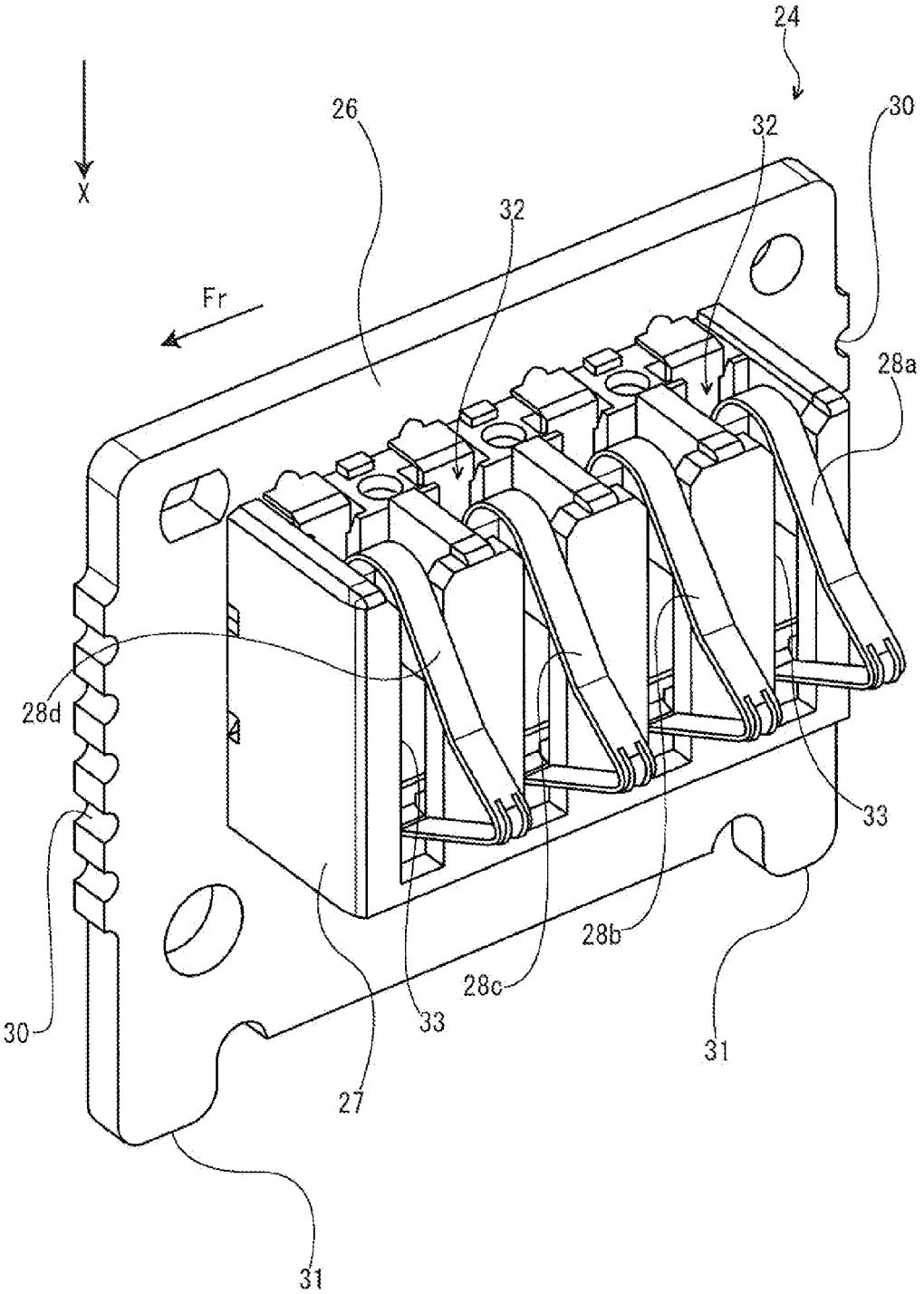
FIG. 4 is a perspective view showing a main body side connector in the printer main body of the printer according to the first embodiment of the present disclosure.

As shown in FIG. 4, the main body side connector 24 includes a main body side board 26, a main body side attaching member 27 fixed to a right side face of the main body side board 26 and four main body side terminals 28*a*-28*d* supported by the main body side attaching member 27. The main body side terminal 28*a*, main body side terminal 28*b*, main body side terminal 28*c* and main body side terminal 28*d* are arranged in order from the back side.

The main body side board 26 is formed in a flat plate-like shape and arranged in a roughly vertical posture. In both edges in the forward and backward directions of the main body side board 26, semicircular grooves 30 are lined up in upward and downward directions. At both end parts in the forward and backward directions of a lower edge of the main body side board 26, protrusions 31 are arranged downward.

In the main body side attaching member 27, four terminal installed parts 32 are lined up in the forward and backward directions. The terminal installed part 32 is formed in a box-like shape. The top face of the terminal installed part 32 is opened. In a right face of the main body side attaching member 27, slits 33 are formed at positions corresponding to the terminal installed parts 32.

The main body side terminals 28*a*-28*d* are lined up in the forward and backward directions. The main body side terminals 28*a*-28*d* are positioned at the same level in the upward and downward directions (a level in the second direction X). The main body side terminals 28*a*-28*d* are formed in a flat spring-like shape. Left side parts of the main body side terminals 28*a*-28*d* are installed in the terminal installed parts 32 of the main body side attaching member 27. Right side parts of the main body side terminals 28*a*-28*d* are projected to the right side of the terminal installed parts 32 via the slits 33.

Figure 5:
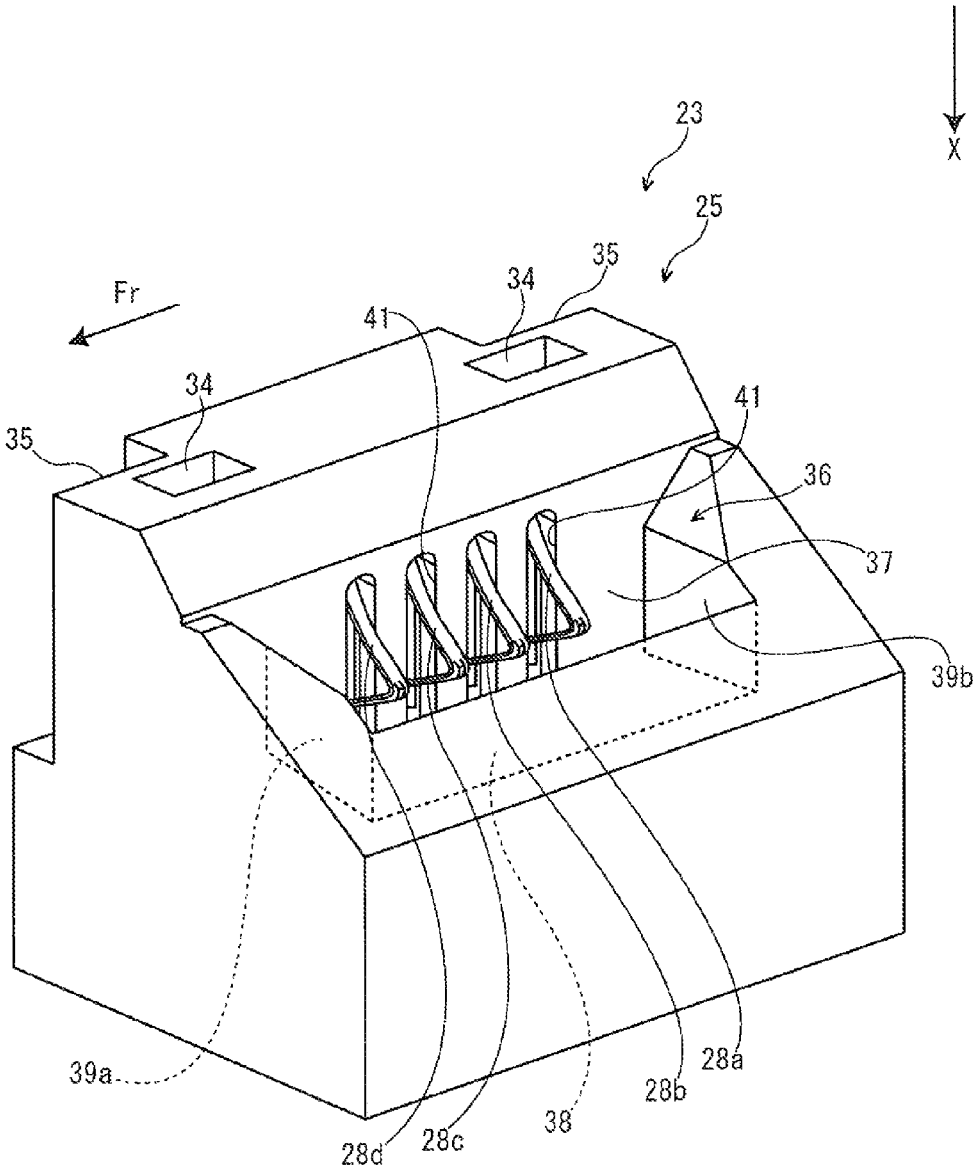
FIG. 5 is a perspective view showing the main body side connecting part in the printer main body of the printer according to the first embodiment of the present disclosure.

As shown in FIG. 5, a part from a left side part to a right end part in a top face of the main body side housing 25 is inclined to the right lower side. In left end part in the top face of the main body side housing 25, a pair of front and rear depressions 34 are formed. Ina left front upper corner part and a left back upper corner part in the main body side housing 25, notches 35 are formed.

In a right side part of the main body side housing 25, a rectangular cylinder-like fitting cylinder part 36 is arranged to extend along the upward and downward directions (a parallel direction to the second direction X). The fitting cylinder part 36 has a first guide wall 37, a second guide wall 38 arranged at the right side of the first guide wall 37 and a pair of third guide walls 39*a* and 39*b* arranged at both sides in the forward and backward directions of the first guide wall 37 and second guide wall 38.

In the first guide wall 37, four inserted holes 41 are formed in a slit-like shape elongated in the upward and downward directions and arranged at intervals in the forward and backward directions. In the inserted holes 41, the main body side terminals 28*a*-28*d* are inserted. That is, the main body side terminals 28*a*-28*d* are arranged to the first guide wall 37. The second guide wall 38 faces to the first guide wall 37 at a predetermined interval.

The pair of the third guide walls 39*a* and 39*b* face to each other at a predetermined interval. The front side guide wall 39*a* connects a front end part of the first guide wall 37 to a front end part of the second guide wall 38. A top end part (an end part at the near side in the second direction X) of the front side guide wall 39*a* is inclined upward (at the near side in the second direction) and forward (at the outside in the forward and backward directions). The rear side guide wall 39*b* connects a rear end part of the first guide wall 37 to a rear end part of the second guide wall 38. A top end part of the rear side guide wall 39*b* is inclined upward (at the near side in the second direction) and backward (at the outside in the forward and backward directions).

As shown in FIG. 3, the main body side housing 25 is formed in a box-like shape having an opened lower side. In a left end part of the inside of the main body side housing 25, a supporting piece 42 is arranged to extend in the upward and downward directions. The supporting piece 42 is arranged across the first guide wall 37 at an opposite side to the second guide wall 38. Between the first guide wall 37 and supporting piece 42, the main body side board 26 and main body side attaching member 27 of the main body side connector 24 is inserted. In the bottom end side of the supporting piece 42, a hook 43 is arranged to protrude to the right side. The hook 43 is engaged with the protrusion 31 arranged at the lower edge of the main body side board 26.

Next, the development device 11 will be described.

Figure 6:
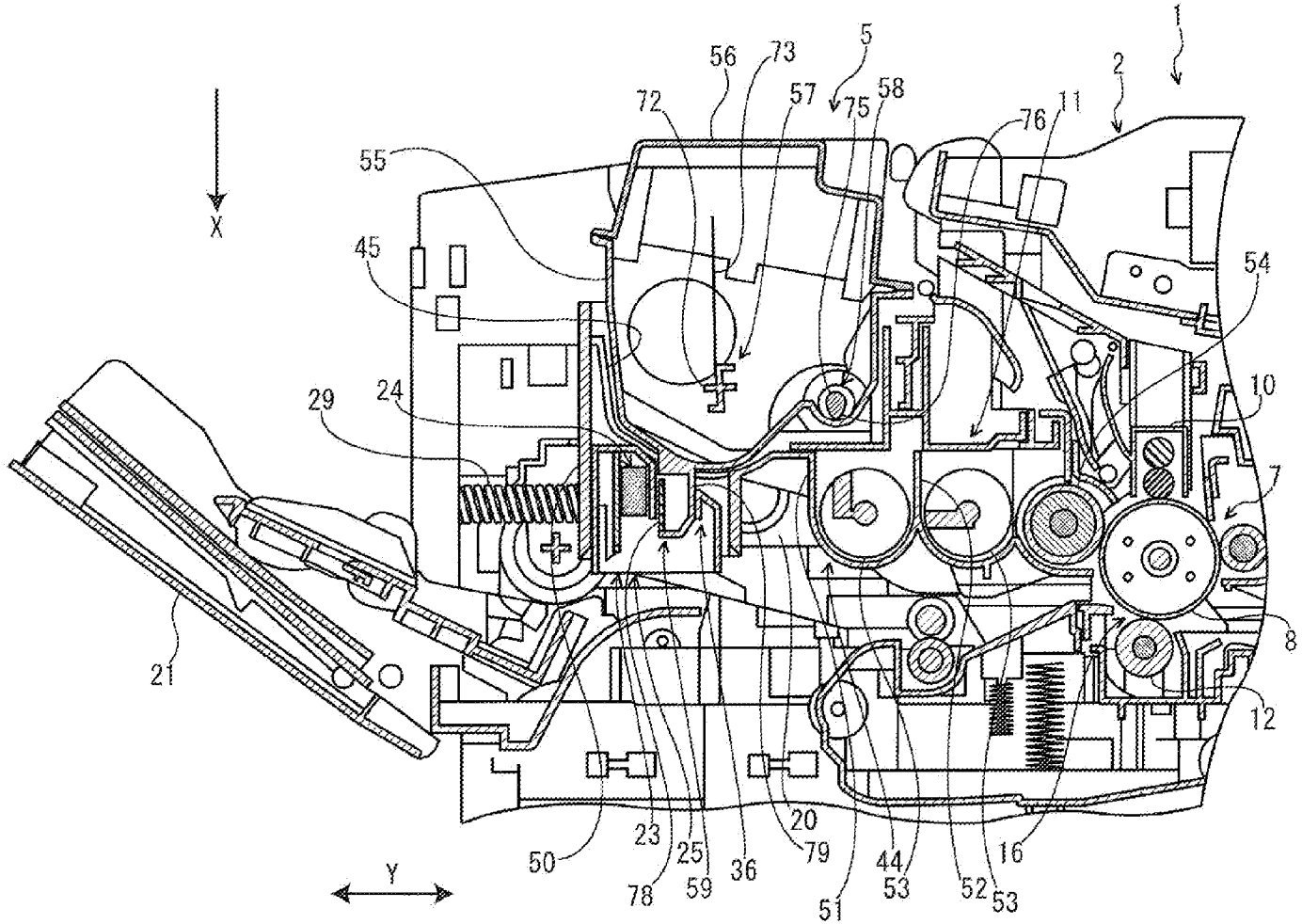
FIG. 6 is a sectional view showing the printer in a situation in which a development device is installed to the printer main body and a toner container is installed to the development device, according to the first embodiment of the present disclosure.

As shown in FIG. 6, the development device 11 is attachably/detachably installed to the installed part 20 of the printer main body 2. The development device 11 is biased to the right side (in a direction approaching the photosensitive drum 8) by the coil spring 29.

Figure 7:
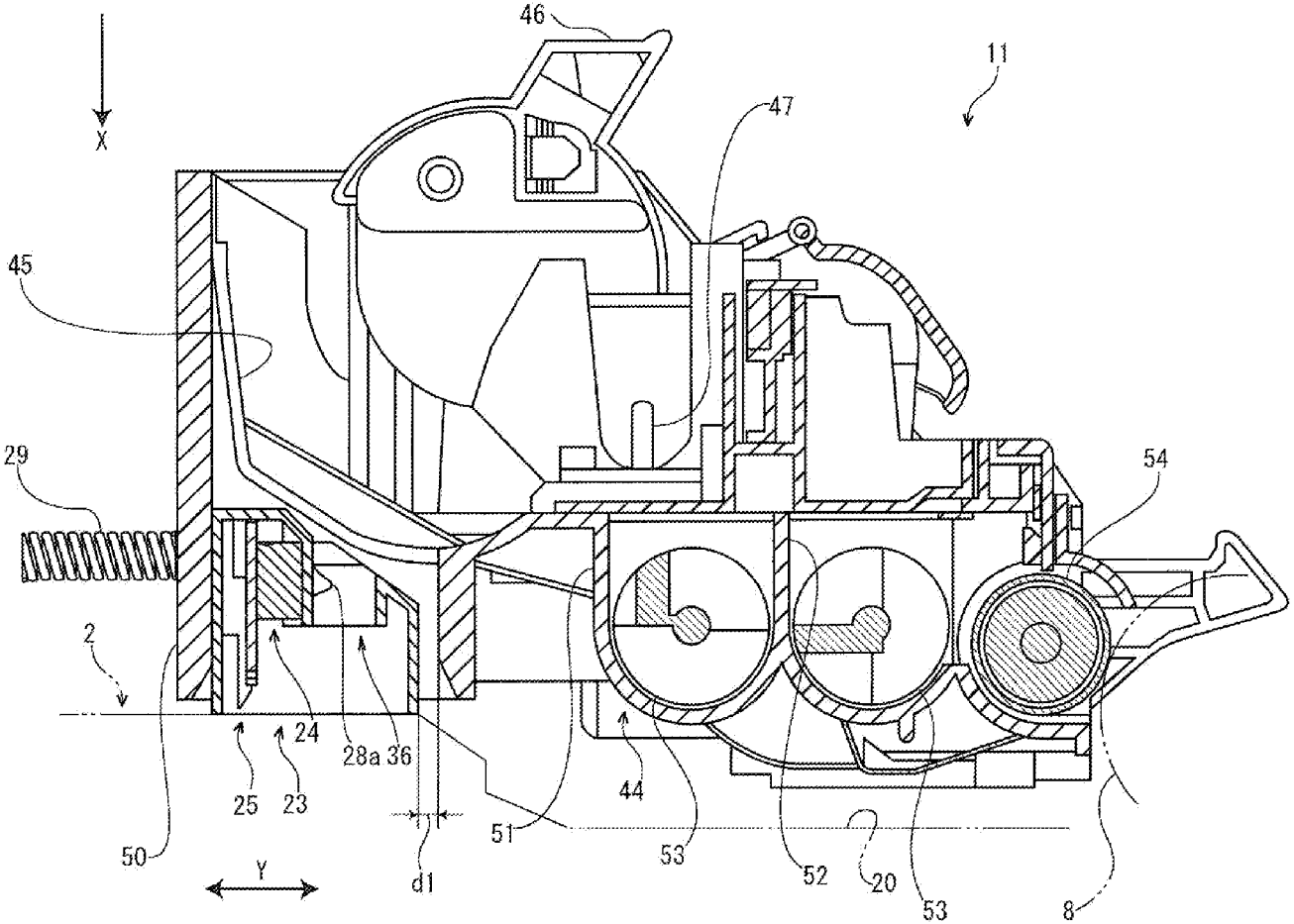
FIG. 7 is a front sectional view illustrating a relationship between the development device and main body side connecting part in the printer according to the first embodiment of the present disclosure.
Figure 8:
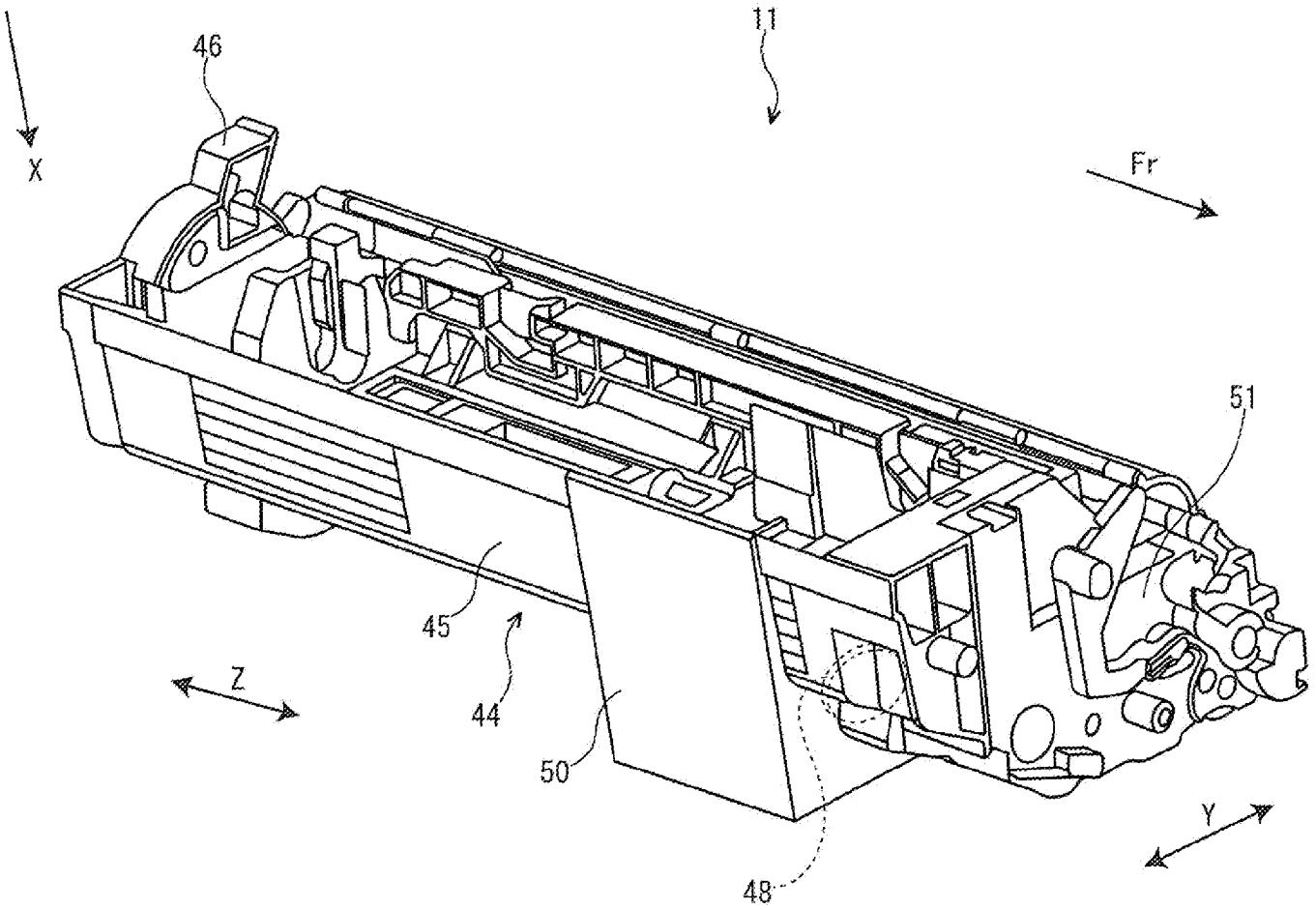
FIG. 8 is a perspective view showing the development device in the printer, as viewed from a left top side, according to the first embodiment of the present disclosure.

As shown in FIG. 7 and other figures, the development device 11 includes a box-like formed development device main body 44. In a left upper part of the development device main body 44, a container holding part 45 opened upward is formed. At a rear end side of the container holding part 45, a lever 46 is arranged. At the right lower side of the lever 46, a drive coupling 47 is arranged. The drive coupling 47 is connected to the lever 46. The drive coupling 47 is configured so as to rotate by manipulating the lever 46. As shown in FIG. 8, at a front end side of the container holding part 45, a drive gear 48 is arranged. The drive gear 48 is connected to a drive source (not shown) composed of a motor or the like.

Figure 9:
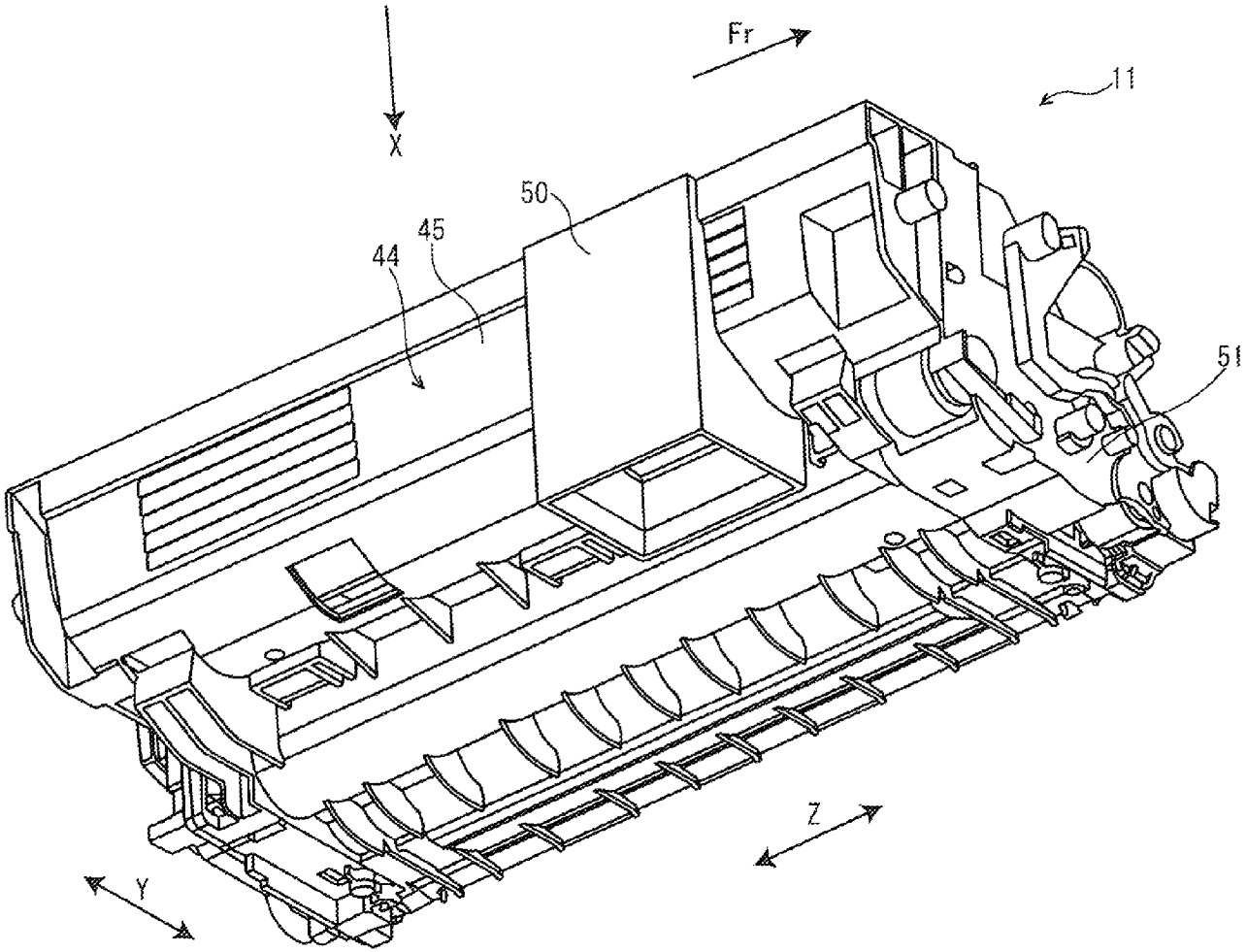
FIG. 9 is a perspective view showing the development device in the printer, as viewed from a left bottom side, according to the first embodiment of the present disclosure.

As shown in FIG. 9 and other figures, in a left front part of the container holding part 45, a fitting part 50 is arranged. The fitting part 50 is formed in a rectangular cylinder shape and arranged along the upward and downward directions. As shown in FIG. 7, the fitting part 50 fits to the outer circumference of the main body side housing 25 with a gap d1 in the first direction Y. Therefore, the development device 11 is configured to be movable in the first direction Yin a situation in which the development device 11 is installed to the printer main body 2.

Figure 10:
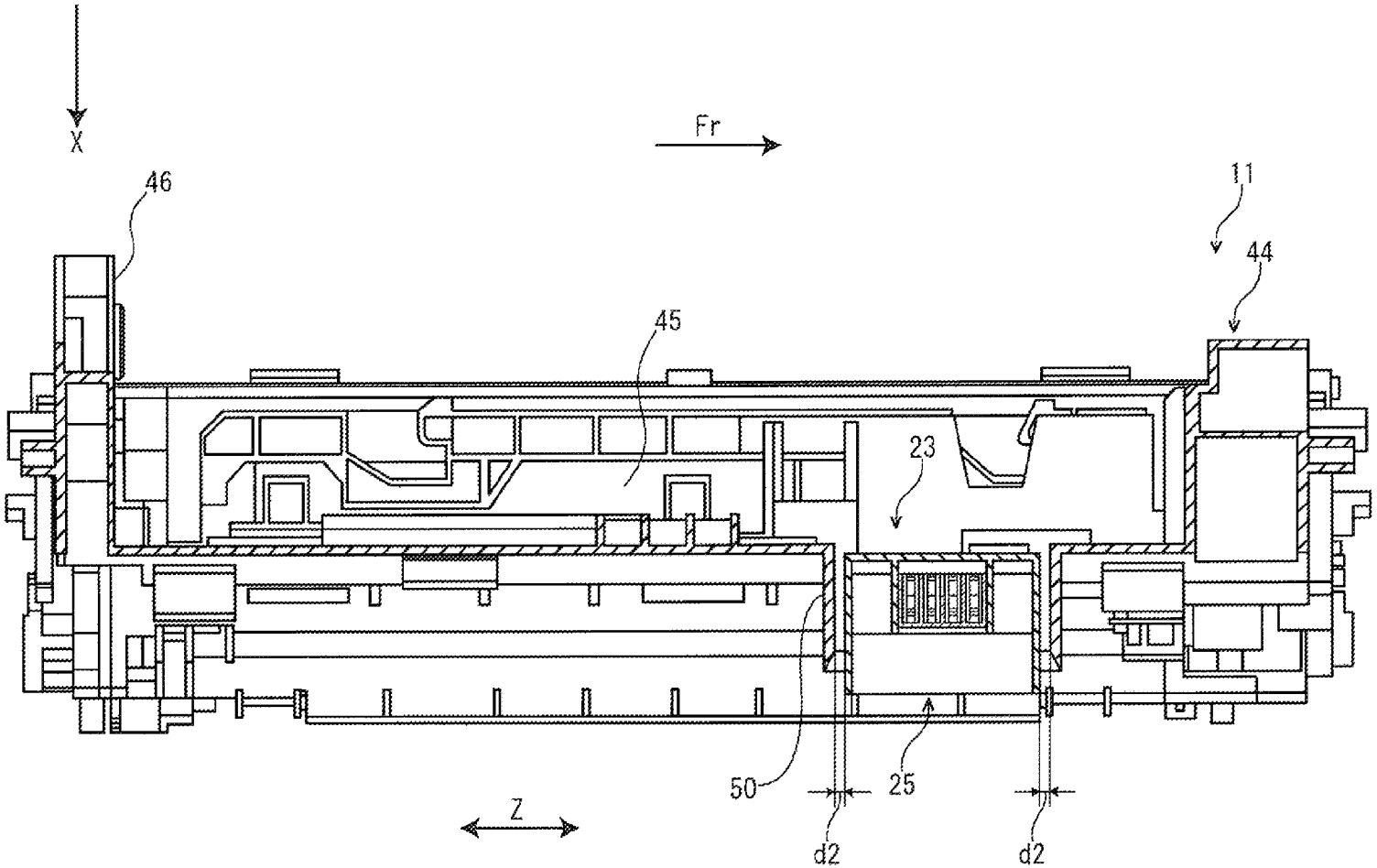
FIG. 10 is a side sectional view illustrating the relationship between the development device and main body side connecting part in the printer according to the first embodiment of the present disclosure.

As shown in FIG. 10, the fitting part 50 fits to the outer circumference of the main body side housing 25 with a gap d2 in the third direction Z. Therefore, the development device 11 is configured to be movable in the third direction Z in a situation in which the development device 11 is installed to the printer main body 2.

As shown in FIG. 7, in a right lower part of the development device main body 44, a toner containing part 51 is formed. In a left side part of the toner containing part 51, a partition wall 52 is vertically arranged, and then, the toner containing part 51 is divided into left and right sides by the partition wall 52. In the left and right sides of the partition wall 52, respective agitating members 53 are arranged. At the right side of the right agitating member 53, a developing roller 54 (a toner carrier) is arranged. The developing roller 54 comes into contact with the photosensitive drum 8.

Next, the toner container 5 will be described.

As shown in FIG. 6 and other figures, the toner container 5 is attachably/detachably installed to the container holding part 45 of the development device 11. The toner container 5 includes a case main body 55, a covering body 56, an agitating paddle 57 (an agitating member), a conveying screw 58 (a conveying member) and a case side connecting part 59. The case main body 55 is formed in a box-like shape having an opened top face. The covering body 56 covers the top face of the case main body 55. The agitating paddle 57 is installed in the roughly center of the case main body 55. The conveying screw 58 is installed in a right lower part of the case main body 55. The case side connecting part 59 is protruded downward from a bottom end of the case main body 55.

Figure 11:
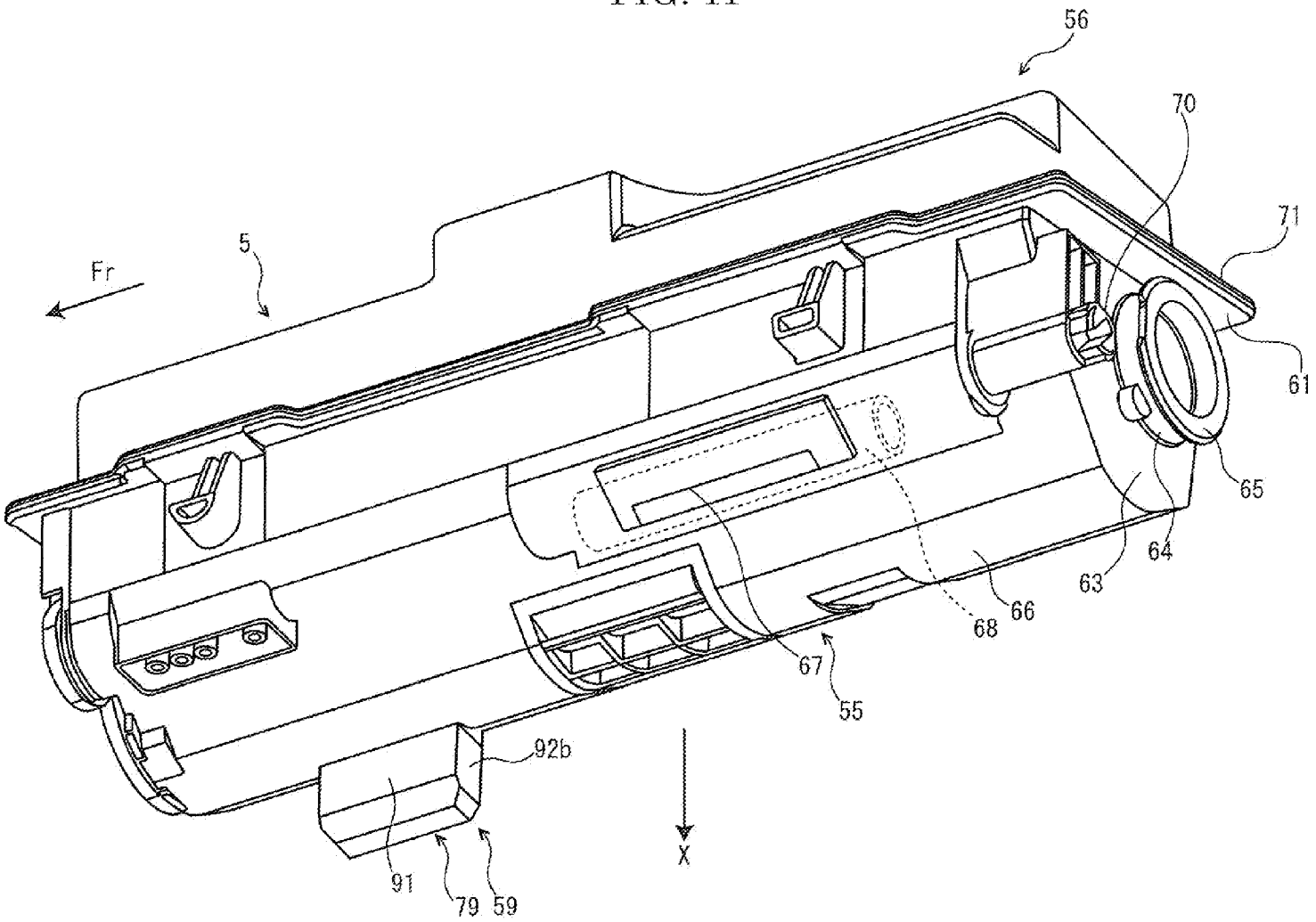
FIG. 11 is a perspective view showing the toner container in the printer, as viewed from a right back side, according to the first embodiment of the present disclosure.

In the case main body 55, the toner is contained. As shown in FIG. 11 and other figures, in the outer circumference of a top end of the case main body 55, a flange part 61 is arranged. In a rear end wall 63 of the case main body 55, a filling port 64 used for filling the toner inside the case main body 55 is arranged. The filling port 64 is closed by a cap 65.

In a right end part of a bottom end wall 66 of the case main body 55, a discharging port 67 used for discharging the toner from the case main body 55 is arranged. The discharging port 67 is closed from the inside by the shutter 68. The shutter 68 is connected to a following coupling 70 protruded to the back side of the rear end wall 63 of the case main body 55. The discharging port 67 is opened/closed by rotating the shutter 68 in accordance with rotation of the following coupling 70. The following coupling 70 is configured to be connected to the drive coupling 47 (see FIG. 7) of the development device 11 in a situation in which the toner container 5 is installed to the development device 11, and accordingly, the shutter 68 is rotated by manipulating the lever 46 connected to the drive coupling 47.

As shown in FIG. 11 and other figures, in the outer circumference of a bottom end of the covering body 56, a flange part 71 having a shape corresponding to the flange part 61 of the case main body 55 is arranged. The case main body 55 and covering body 56 are united by ultrasonic-welding the flange part 61 and flange part 71.

As shown in FIG. 6, the agitating paddle 57 includes an attachment frame 72 and an agitating blade 73 supported by the attachment frame 72. The attachment frame 72 is pivotally supported by the case main body 55. Thereby, the agitating paddle 57 is rotatable with respect to the case main body 55. To a front end part of the attachment frame 72, an agitating gear 74 (see FIG. 12) is fixed. The agitating gear 74 is located at the front side (at the outside) of the front end wall 62 of the case main body 55. The agitating gear 74 is configured so as to mesh with the drive gear 48 (see FIG. 8) of the development device 11 in a situation in which the toner container 5 is installed to the development device 11. The agitating blade 73 is made of a synthetic resin film, such as a PET (Polyethylene Terephthalate) film and has flexibility.

As shown in FIG. 6, the conveying screw 58 includes a bar-like rotating shaft 75 and a spiral fin 76 arranged to be concentric with the outer circumference of the rotating shaft 75. The rotating shaft 75 is pivotally supported by the case main body 55. Thereby, the conveying screw 58 is rotatable with respect to the case main body 55. To a front end part of the rotating shaft 75, a conveying gear 77 (see FIG. 12) is fixed. The conveying gear 77 is located at the front side (at the outside) of the front end wall 62 of the case main body 55. The conveying gear 77 is meshed with the agitating gear 74.

Figure 12:
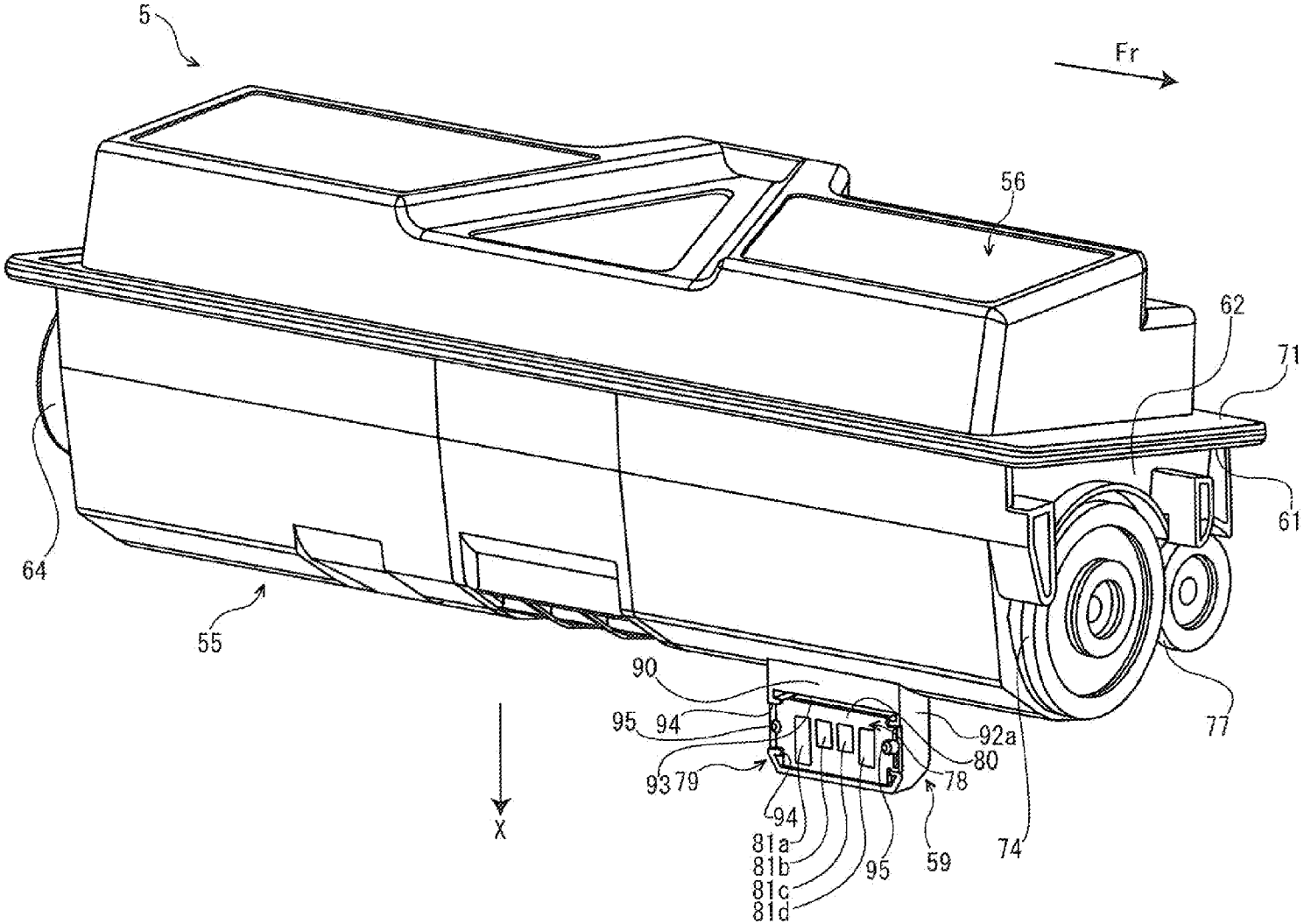
FIG. 12 is a perspective view showing the toner container in the printer, as viewed from a left front side, according to the first embodiment of the present disclosure.

As shown in FIG. 12, the case side connecting part 59 includes a case side connector 78 and a case side housing 79 holding the case side connector 78.

Figure 13:
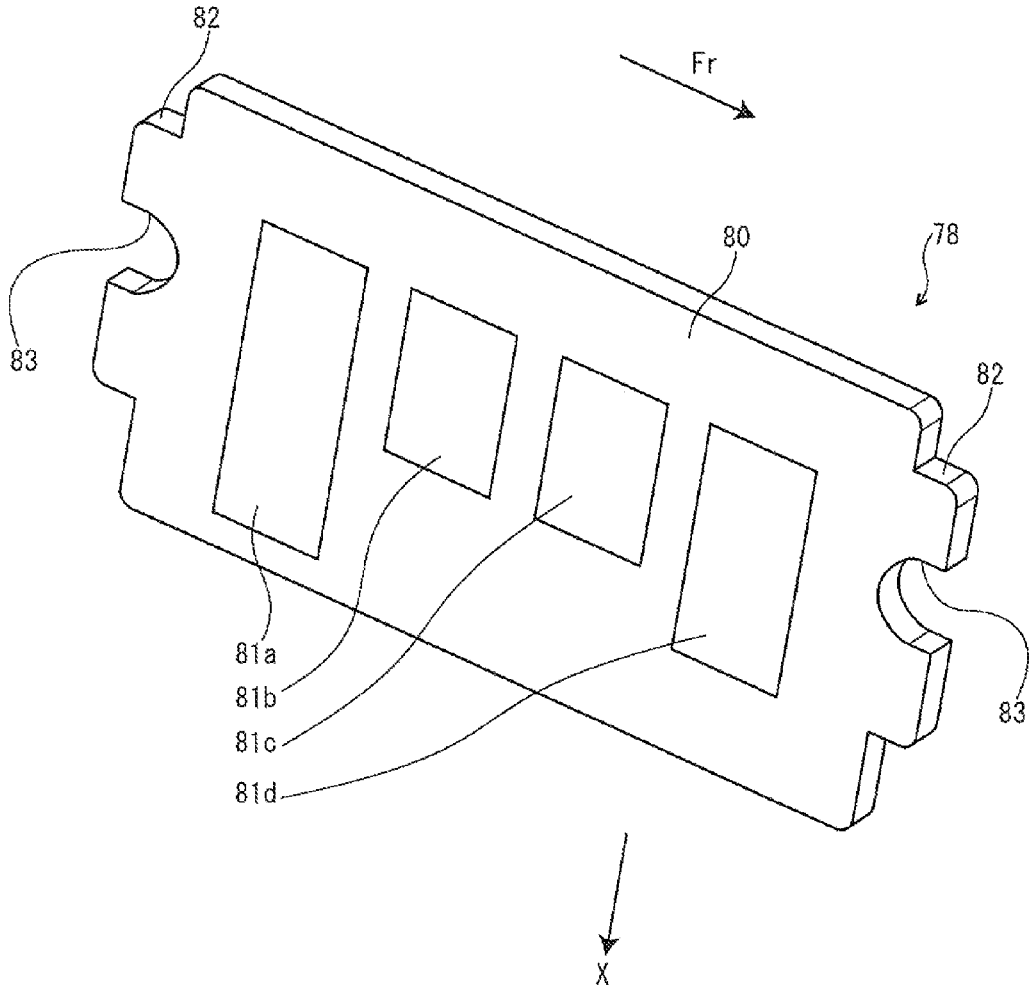
FIG. 13 is a perspective view showing a case side connector in the toner container of the printer according to the first embodiment of the present disclosure.

The case side connector 78 is an information chip configured to store various information relating to the toner container 5 (for example, a serial number of the toner container 5). As shown in FIG. 13, the case side connector 78 includes a case side board 80 and four case side terminals 81*a*-81*d* attached to the case side board 80. The case side terminal 81*a*, case side terminal 81*b*, case side terminal 81*c* and case side terminal 81*d* are arranged in order from the back side.

In four upper, lower, front and rear corners of the case side board 80 are cut out to form fixed grooves 82. In both edges in the forward and backward directions of the case side board 80, semicircular attachment grooves 83 are recessed.

The case side terminals 81*a*-81*d* are formed in a vertically elongated rectangular shape. The case side terminal 81*a* is, for example, a ground terminal (an earth terminal). The case side terminal 81*b* is, for example, a clock terminal. The case side terminal 81*c* is, for example, a signal terminal. The case side terminal 81*d* is, for example, a power supply terminal.

Top ends of the case side terminals 81*a*-81*d* are positioned at the same level as each other. As for lengths in the upward and downward directions (lengths in the second direction X) of the case side terminals 81*a*-81*d*, a length of the case side terminal 81*a* is longest, a length of the case side terminal 81*d* is second longest and lengths of the case side terminals 81*b* and 81*c* are shortest. Therefore, as for bottom end positions (positions of end parts at the far side in the second direction X) of the case side terminals 81*a*-81*d*, a position of the case side terminal 81*a* is lowest, a position of the case side terminal 81*d* is second lowest and positions of the case side terminals 81*b* and 81*c* are highest.

As shown in FIGS. 11 and 12, the case side housing 79 has a first wall part 90, a second wall part 91 arranged at an opposite side to the first wall part 90 and a pair of front and rear side wall parts 92*a* and 92*b* connecting the first wall part 90 and second wall part 91.

As shown in FIG. 12, in a part from an upper part to a bottom end part in the first wall part 90, a fixed depression 93 is arranged, and then, in the fixed depression 93, a case side connector 78 is installed. Therefore, the case side terminals 81*a*-81*d* are located in the first wall part 90. In four upper, lower, front and rear corners of the fixed depression 93, fixing pieces 94 are arranged, and then, each fixing piece 94 is engaged with each fixed groove 82 (see FIG. 13). In both end parts in the forward and backward directions of the fixed depression 93, screws 95 are fastened. The screws 95 penetrate the attachment grooves 83 (see FIG. 13) of the case side board 80. Bottom end parts of the second wall part 91 and pair of the side wall parts 92*a* and 92*b* are inclined downward (to the far side in the second direction X) and inward.

A method of supplying the toner to the photosensitive drum 8 in the above-mentioned configuration will be described.

First, the lever 46 of the development device 11 is manipulated in a situation in which the toner container 5 is installed to the development device 11 and the development device 11 is installed to the printer main body 2. When the lever 46 of the development device 11 is thus manipulated, the drive coupling 47 connected to the lever 46 is rotated and the following coupling 70 connected to the drive coupling 47 is also rotated. When the following coupling 70 is thus rotated, the shutter 68 connected to the following coupling 70 is rotated, and then, the shutter 68 opens the discharging port 67 of the toner container 5.

In such a situation, when the drive source (not shown) is driven, the drive gear 48 of the development device 11 is rotated. When the drive gear 48 is thus rotated, the rotation is transmitted to the agitating paddle 57 via the agitating gear 74, and then, the agitating paddle 57 is rotated. According to this, the toner in the case main body 55 is agitated and conveyed to the conveying screw 58's side.

In addition, when the drive gear 48 is rotated as mentioned above, the rotation is transmitted to the conveying screw 58 via the agitating gear 74 and conveying gear 77, and then, the conveying screw 58 is rotated. According to this, the toner in the case main body 55 is discharged from the discharging port 67 and supplied to the toner containing part 51 of the development device main body 44. The toner supplied to the toner containing part 51 of the development device main body 44 is agitated by the agitating members 53, conveyed to the developing roller 54 and supplied from the developing roller 54 to the photosensitive drum 8.

Next, a method of attaching/detaching the toner container 5 to/from the development device 11 in the above-mentioned configuration will be described. The method is described on the presupposition that the development device 11 is installed to the printer main body 2.

Figure 14B:
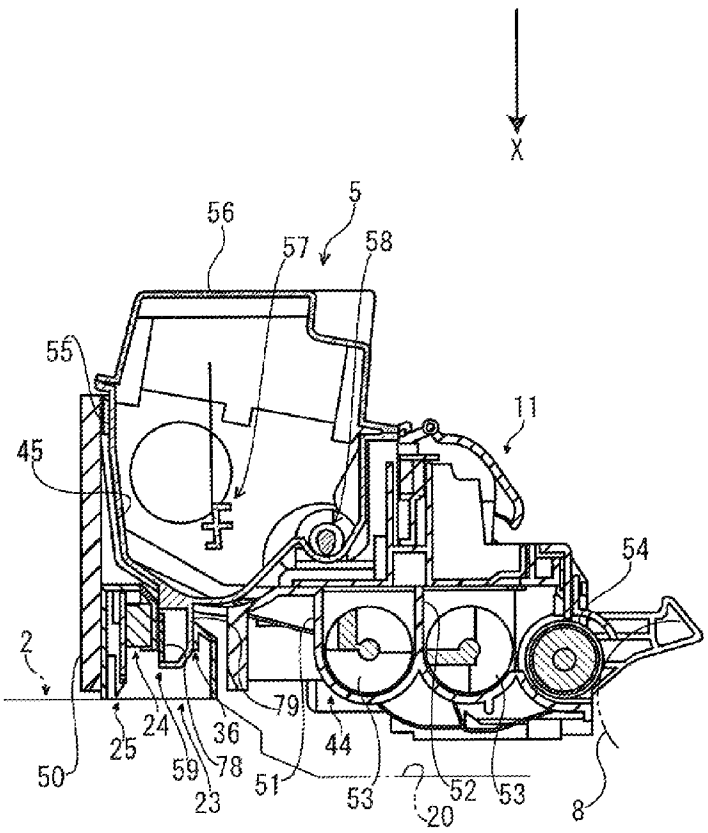
FIG. 14B is another sectional view showing the printer in another situation in which the toner container has been installed to the development device, according to the first embodiment of the present disclosure.
Figure 14A:
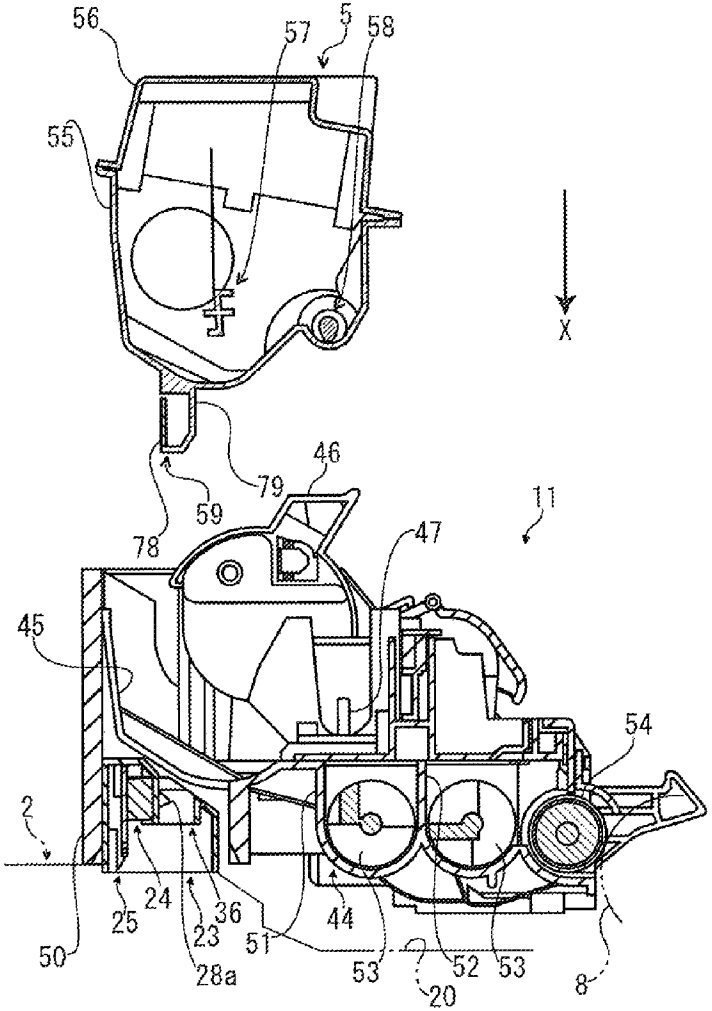
FIG. 14A is a sectional view showing the printer in a situation before the toner container is attached to the development device according to the first embodiment of the present disclosure.
Figure 15:
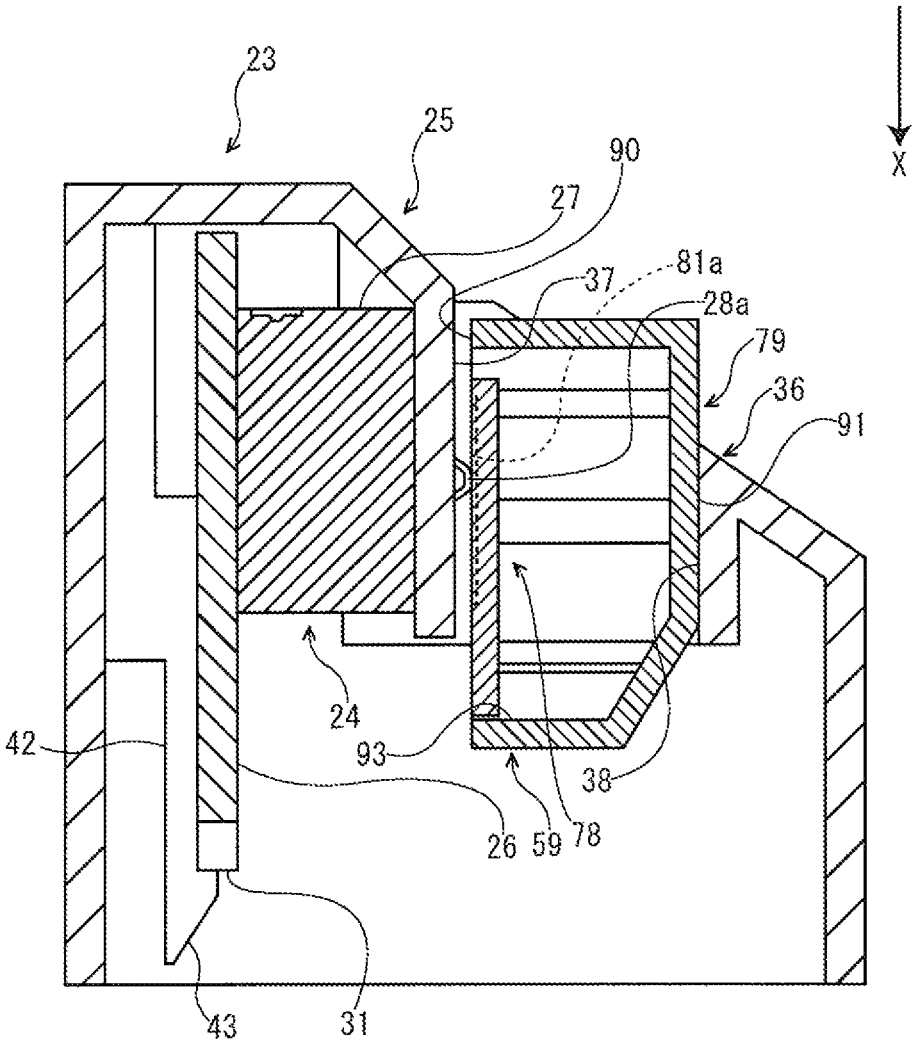
FIG. 15 is a sectional view showing the printer in a situation in which a case side housing fits to a fitting cylinder part of a main body side housing, according to the first embodiment of the present disclosure.

In a case where the toner container 5 is attached to the development device 11, as shown in FIG. 14A, the toner container 5 is held above the development device 11. Subsequently, the toner container 5 is taken down along the second direction X, and then, as shown in FIG. 14B, the toner container 5 is attached to the container holding part 45 of development device 11. According to this, as shown in FIG. 15, the case side housing 79 fits to the fitting cylinder part 36 of the main body side housing 25 and the case side terminals 81*a*-81*d* come into contact with the main body side terminals 28*a*-28*d*. Thereby, it is possible to carry out contact communication between the main body side connector 24 and case side connector 78. Incidentally, in a case where the toner container 5 is detached from the development device 11, the toner container 5 is lifted up from the development device 11 in a converse manner to the above-mentioned manner.

Next, a method of attaching/detaching the development device 11 to/from the printer main body 2 in the above-mentioned configuration will be described. The method is described on the presupposition that the toner container 5 is installed to the development device 11.

Figure 16:
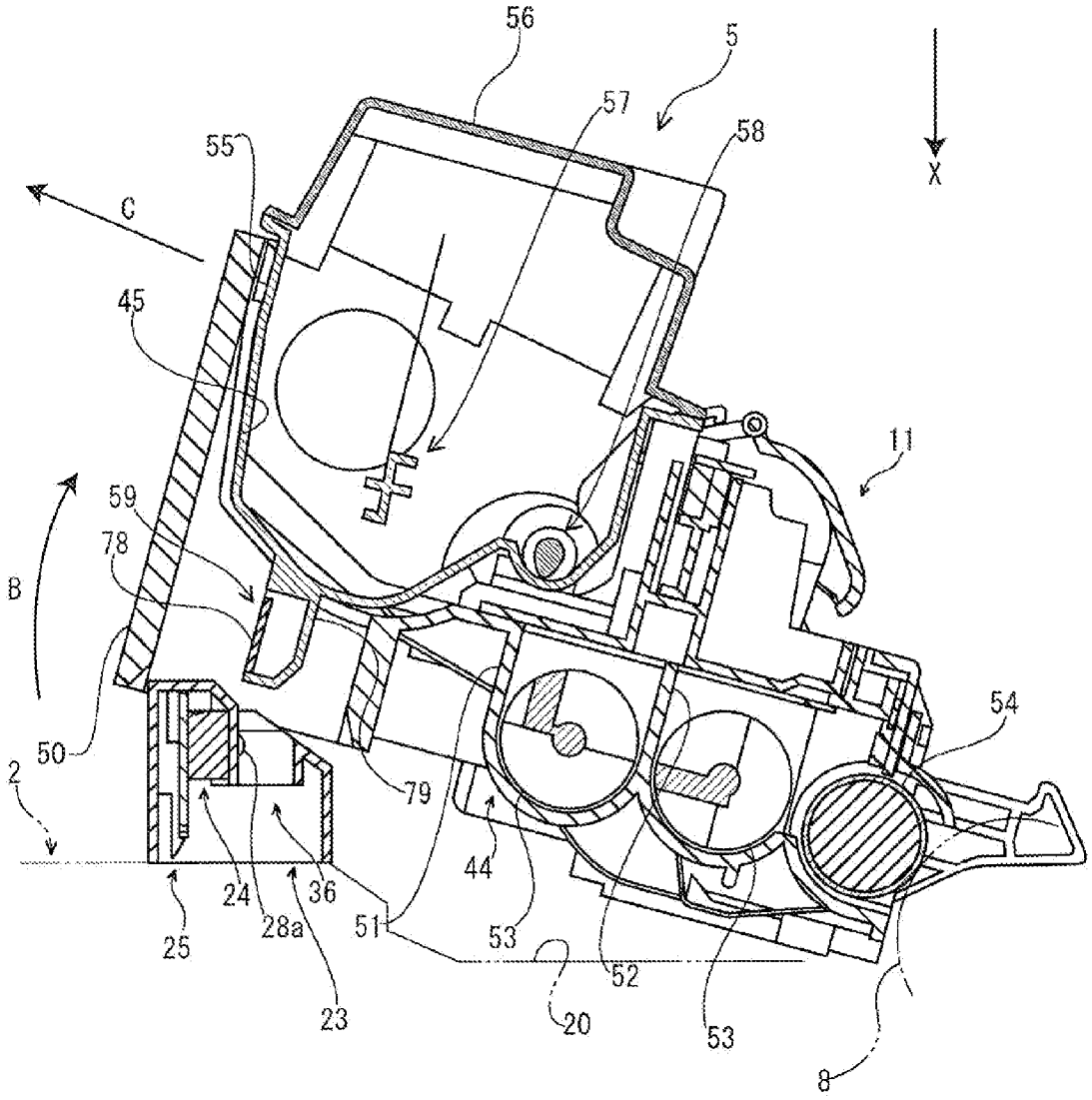
FIG. 16 is a sectional view showing the printer in a situation in the middle of detaching the development device, to which the toner container is installed, from the printer main body according to the first embodiment of the present disclosure.

In a case where the development device 11 is detached from the printer main body 2, as indicated by an arrow B in FIG. 16, the development device 11 is turned around the right end side (the photosensitive drum 8's side) and the left end side (the container holding part 45's side) of the development device 11 is moved upward. According to this, the toner container 5 installed to the container holding part 45 of the development device 11 is moved upward, and then, the fitting of the case side housing 79 to the fitting cylinder part 36 of the main body side housing 25 is released, and simultaneously, the case side terminals 81*a*-81*d* are separated from the main body side terminals 28*a*-28*d*. In such a situation, as indicated by an arrow C in FIG. 16, the development device 11 is extracted to the left upper side. Thereby, the development device 11 is detached from the printer main body 2 (see FIG. 2).

Incidentally, in a case where the development device 11 is attached to the printer main body 2, the development device 11 is pushed to the installed part 20 of the printer main body 2, and then, the development device 11 is turned around the right end side (the photosensitive drum 8's side) and the left end side (the container holding part 45's side) of the development device 11 is moved downward. According to this, the toner container 5 installed to the container holding part 45 of the development device 11 is moved downward, and then, the case side housing 79 fits to the fitting cylinder part 36 of the main body side housing 25, and simultaneously, the case side terminals 81*a*-81*d* come into contact with the main body side terminals 28*a*-28*d*.

In the embodiment, as mentioned above, since the development device 11 is configured to be movable in the first direction Y in a situation in which the development device 11 is installed to the printer main body 2, it is possible to adjust the position of the development device 11 to the photosensitive drum 8. According to this, it is possible to locate the development device 11 at a suitable position to the photosensitive drum 8 and to supply a suitable amount of the toner from the developing roller 54 of the development device 11 to the photosensitive drum 8. Particularly, in the embodiment, the coil spring 29 is arranged to the printer main body 2 to bias the development device 11 in the direction approaching the photosensitive drum 8. Therefore, it is possible to easily optimize the position of the development device 11 to the photosensitive drum 8.

In a situation, in which the development device 11 is installed to the printer main body 2 and the toner container 5 is installed to the development device 11, the case side housing 79 fits to the fitting cylinder part 36 of the main body side housing 25 and the case side terminals 81*a*-81*d* come into contact with the main body side terminals 28*a*-28*d*. By applying such a configuration, it is possible to securely contact the case side terminals 81*a*-81*d* to the main body side terminals 28*a*-28*d* and to avoid communication failure between the main body side connector 24 and case side connector 78.

The development device 11 includes the fitting part 50 fitting to the main body side housing 25 with the gap d1 in the first direction Y. By applying such a configuration, it is possible to move the development device 11 in the first direction Y without a movement of the main body side connecting part 23 and case side connecting part 59.

The fitting part 50 fits to the main body side housing 25 with the gap d2 in the third direction Z. By applying such a configuration, it is possible to move the development device 11 in the third direction Z. Therefore, when the development device 11 is moved in the first direction Y, even if the force in the third direction Z is added to the development device 11, it is possible to easily move the development device 11.

In the embodiment, the fitting part 50 of the development device 11 is positioned to the main body side housing 25 of the printer main body 2 and the toner container 5 is positioned to the container holding part 45 of the development device 11. By applying such a configuration, it is possible to correctly position the printer main body 2, development device 11 and toner container 5.

Figure 17:
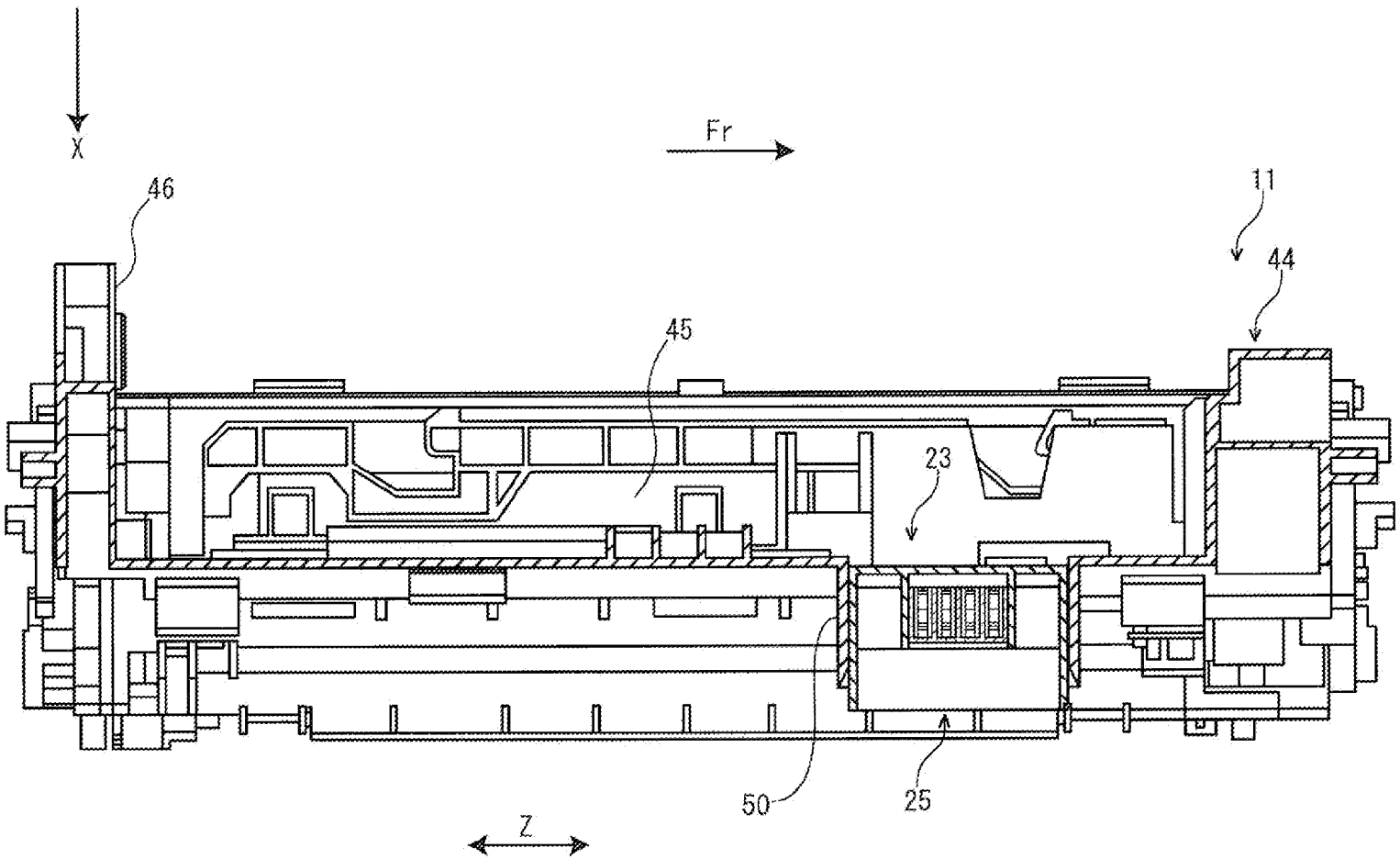
FIG. 17 is a side sectional view illustrating the relationship between the development device and main body side connecting part in the printer according to another embodiment of the present disclosure.

In the embodiment, the development device 11 is configured to be movable in both of the first direction Y and third direction Z. By contrast, in another embodiment, as shown in FIG. 17, the fitting part 50 may fit to the main body side housing 25 without a gap in the third direction Z, and accordingly, the development device 11 may be configured to be movable in the first direction Y. By applying such a configuration, it is possible to correctly position the printer main body 2, development device 11 and toner container 5 in the third direction Z.

In the embodiment, the second direction X is set to the direction from the upper side to the lower side (the vertical direction). By contrast, in another embodiment, the second direction X may be set to the horizontal direction or an inclined direction to the vertical direction and horizontal direction.

In the embodiment, the developing roller 54 is configured to come into contact with the photosensitive drum 8. By contrast, in another embodiment, the developing roller 54 may be configured to face to the photosensitive drum 8 at a distance.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Second Embodiment

Figure 18:
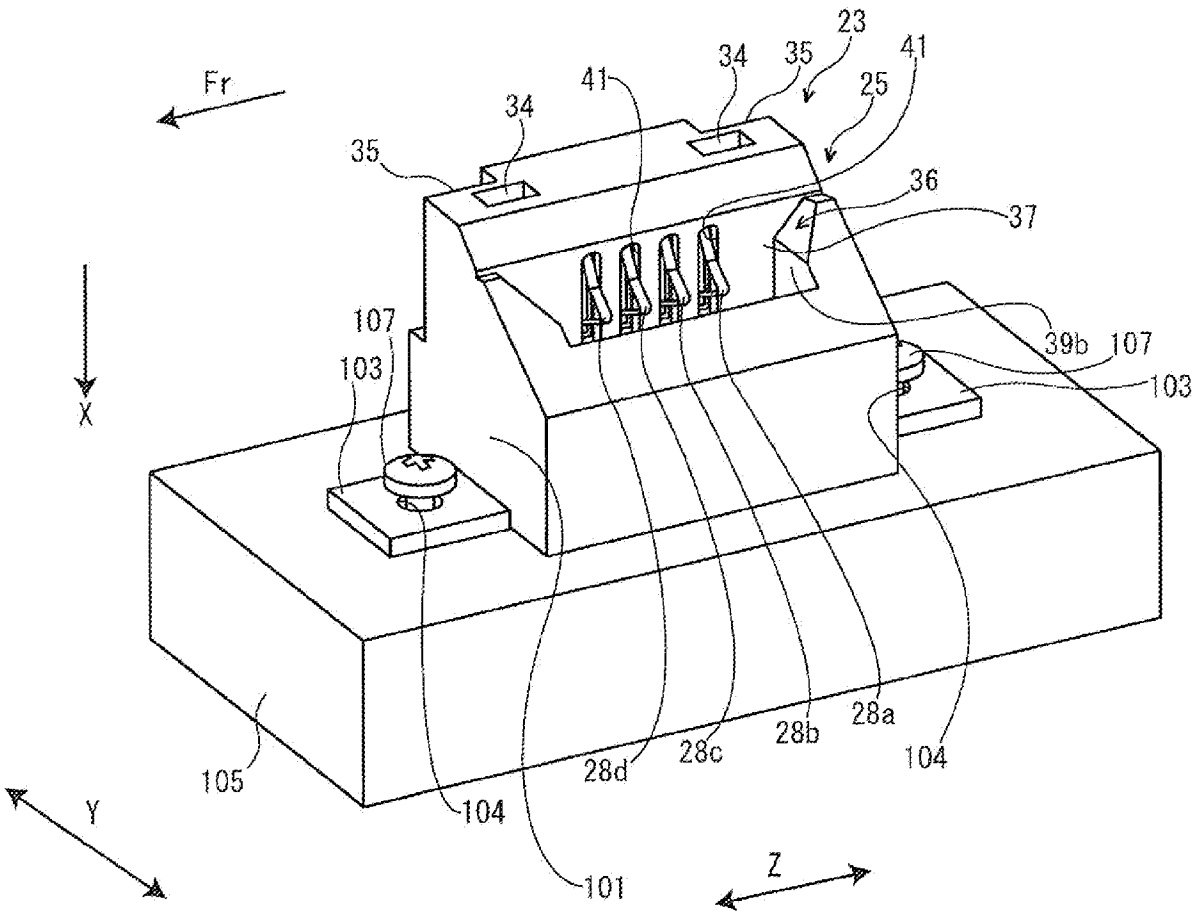
FIG. 18 is a perspective view showing the main body side connecting part and a supporting member in the printer main body of the printer according to a second embodiment of the present disclosure.

Next, the second embodiment of the present disclosure will be described with reference to FIGS. 18 and 19. The description of the same parts as the first embodiment is omitted.

In bottom ends of a front wall 101 and a rear wall 102 of the main body side housing 25, protruding pieces 103 are arranged to the outside in the forward and backward directions. In each protruding piece 103, a through hole 104 is bored in the upward and downward directions. To the outer circumference of the main body side housing 25, the fitting part 50 of the development device 11 (not shown in FIGS. 18 and 19) fits without a gap in the first direction Y and third direction Z.

The main body side housing 25 is located on the supporting member 105 arranged in the printer main body 2. In the supporting member 105, a pair of front and rear attachment holes 106 are arranged. An attaching screw 107 penetrating the through hole 104 of each protruding piece 103 of the main body side housing 25 is inserted into each attachment hole 106, thereby attaching the main body side housing 25 to the supporting member 105.

Figure 19A:
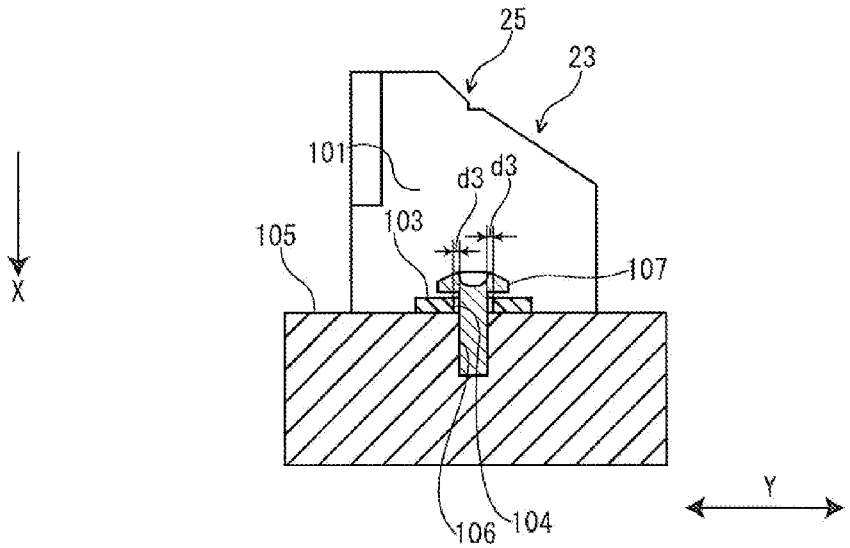
FIG. 19A is a front sectional view showing the main body side connecting part and supporting member in the printer main body of the printer according to the second embodiment of the present disclosure.

As shown in FIG. 19A, between each attaching screw 107 and the through hole 104 of each protruding piece 103, a gap d3 is arranged in the first direction Y. Therefore, the main body side connecting part 23 is supported by the supporting member 105 in a movable state in the first direction Y. In other words, the main body side connecting part 23 is supported by the supporting member 105 with backlash in the first direction Y. By applying such a configuration, it is possible to move the development device 11 and main body side connecting part 23 in a body.

Figure 19B:
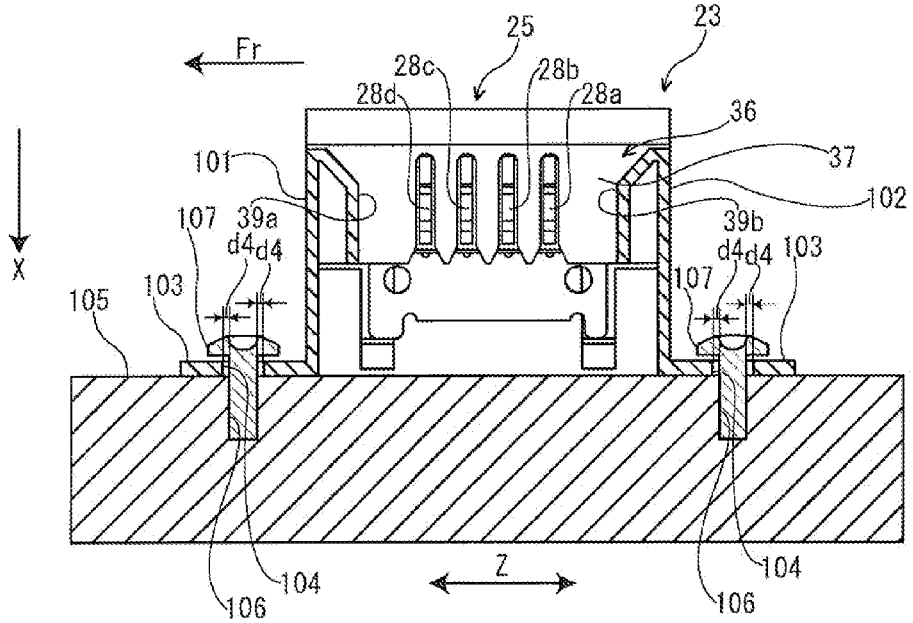
FIG. 19B is a side sectional view showing the main body side connecting part and supporting member in the printer main body of the printer according to the second embodiment of the present disclosure.

As shown in FIG. 19B, between each attaching screw 107 and the through hole 104 of each protruding piece 103, a gap d4 is arranged in the third direction Z. Therefore, the main body side connecting part 23 is supported by the supporting member 105 in a movable state in the third direction Z. In other words, the main body side connecting part 23 is supported by the supporting member 105 with backlash in the third direction Z. By applying such a configuration, it is possible to move the development device 11 in the third direction Z. Therefore, when the development device 11 is moved in the first direction Y, even if the force in the third direction Z is added to the development device 11, it is possible to easily move the development device 11.

Figure 20A:
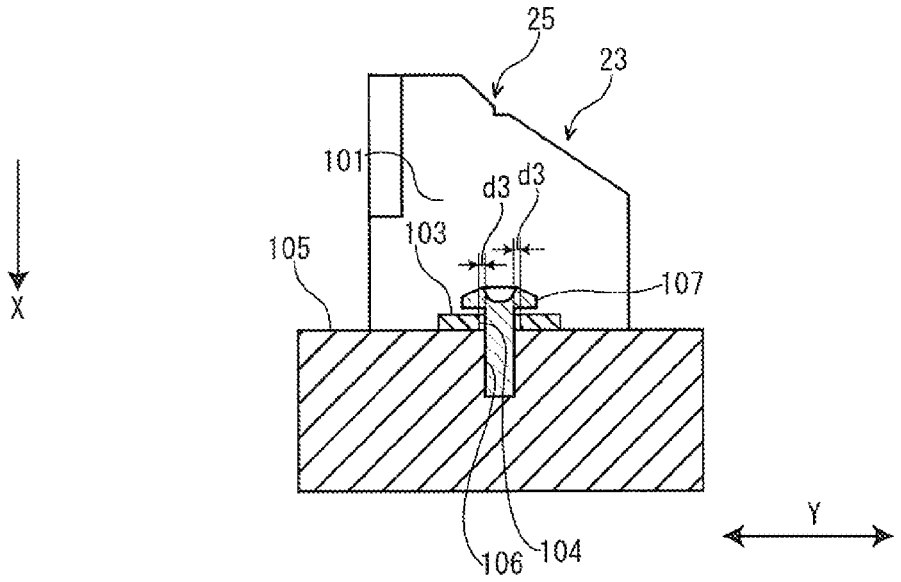
FIG. 20A is a front sectional view showing the main body side connecting part and supporting member in the printer main body of the printer according to a further embodiment of the present disclosure.
Figure 20B:
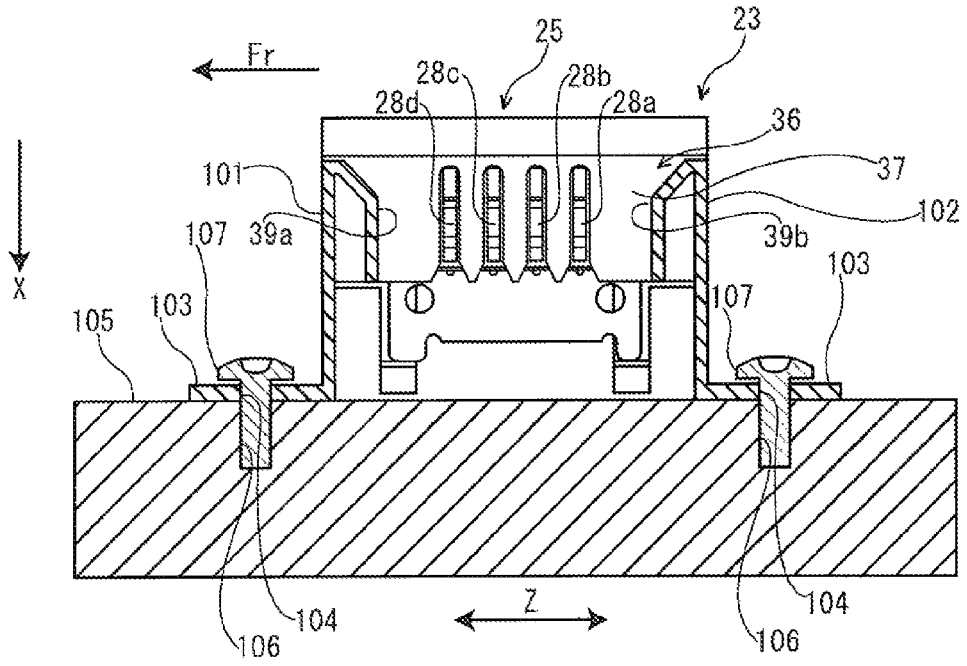
FIG. 20B is a side sectional view showing the main body side connecting part and supporting member in the printer main body of the printer according to the further embodiment of the present disclosure.

In the embodiment, since the main body side connecting part 23 is supported by the supporting member 105 with the backlash in the third direction Z, the main body side connecting part 23 is supported by the supporting member 105 in the movable state in the third direction Z. By contrast, in another embodiment, as shown in FIGS. 20A and 20B, by supporting the main body side connecting part 23 by the supporting member 105 without a backlash in the third direction Z, the main body side connecting part 23 may be supported by the supporting member 105 in a state that the movement in the third direction Z is restricted. By applying such a configuration, it is possible to correctly position the printer main body 2, development device 11 and toner container 5 in the third direction Z.

Third Embodiment

Figure 21:
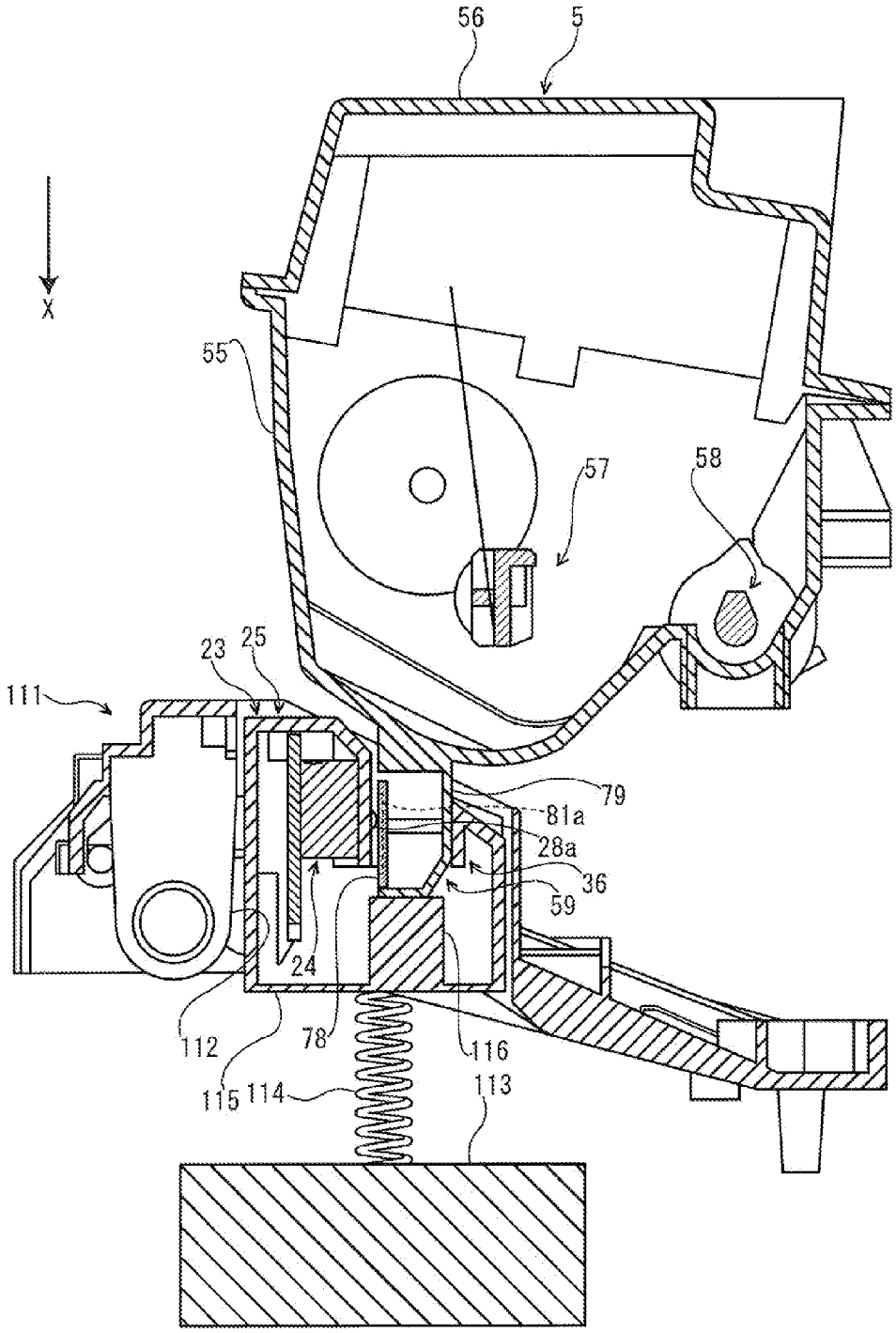
FIG. 21 is a sectional view showing the printer in a situation in which the case side housing fits to the fitting cylinder part of the main body side housing, according to a third embodiment of the present disclosure.

Next, the third embodiment of the present disclosure will be described with reference to FIG. 21. The description of the same parts as the first embodiment is omitted.

In the printer main body 2, a guide member 111 is arranged. In the guide member 111, a guide hole 112 is arranged in the upward and downward directions (a parallel direction to the second direction X). To the guide hole 112, the main body side connecting part 23 is installed in a movable state along the second direction X.

In the printer main body 2, a spring reception part 113 is arranged below the main body side connecting part 23. Between the bottom wall 115 of the main body side housing 25 of the main body side connecting part 23 and spring reception part 113, a coil spring 114 (a biasing member) is inserted. The coil spring 114 biases the main body side connecting part 23 upward (to the near side in the second direction X). In the bottom wall 115 of the main body side housing 25 of the main body side connecting part 23, a pedestal part 116 is protruded upward at a position corresponding to the fitting cylinder part 36 of the main body side housing 25.

In such a configuration, when the toner container 5 is installed to the development device 11, a bottom end part of the case side housing 79 of the case side connecting part 59 comes into contact with a top face of the pedestal part 116. Thereby, it is possible to correctly position the main body side connecting part 23 and case side connecting part 59 in the second direction X. Therefore, it is possible to more securely contact the main body side terminals 28*a*-28*d* to the case side terminals 81*a*-81*d*.

Fourth Embodiment

Figure 22:
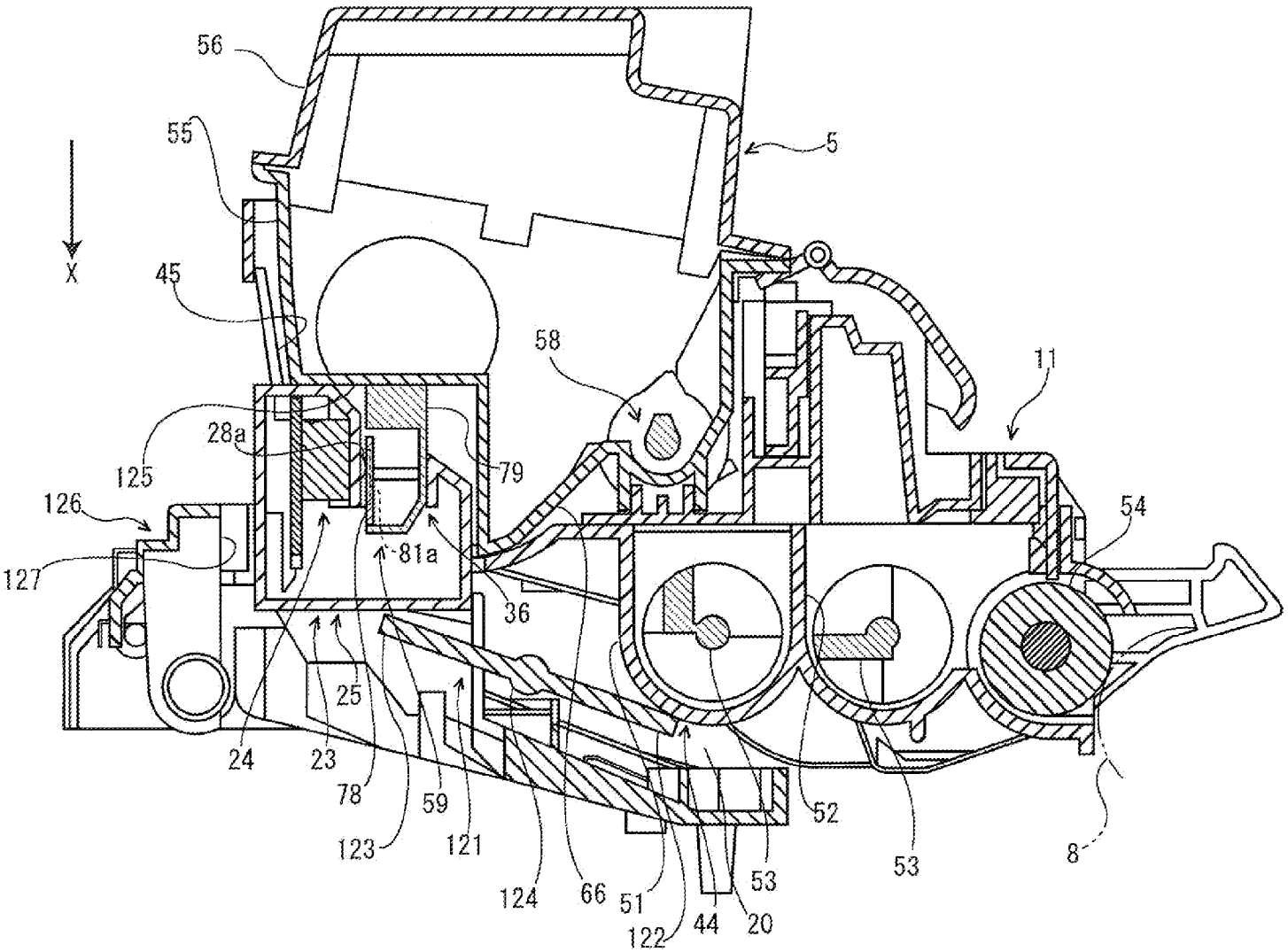
FIG. 22 is a sectional view showing the printer in a situation in which the development device has been installed to an installed part of the printer main body, according to a fourth embodiment of the present disclosure.

Next, the fourth embodiment of the present disclosure will be described with reference to FIGS. 22 and 23. The description of the same parts as the first embodiment is omitted.

In the printer main body 2, a guide member 126 is arranged. In the guide member 126, a guide hole 127 is arranged in the upward and downward directions (a parallel direction to the second direction X). To the guide hole 127, the main body side connecting part 23 is installed in a movable state along the second direction X.

In the printer main body 2, a swinging member 121 is arranged. In a right end part of the swinging member 121, a pressured part 122 is arranged. The pressured part 122 is inserted in the installed part 20. In a left end part of the swinging member 121, a pressuring part 123 is arranged. The pressuring part 123 is located at the lower side (at the far side in the second direction X) of the main body side connecting part 23. In the center in the left and right directions of the swinging member 121, a fulcrum part 124 is arranged between the pressured part 122 and pressuring part 123. The swinging member 121 is configured to be swingable around the fulcrum part 124.

In the bottom end wall 66 of the case main body 55 of the toner container 5, a depression part 125 is formed. In the depression part 125, the case side connecting part 59 is arranged.

Figure 23:
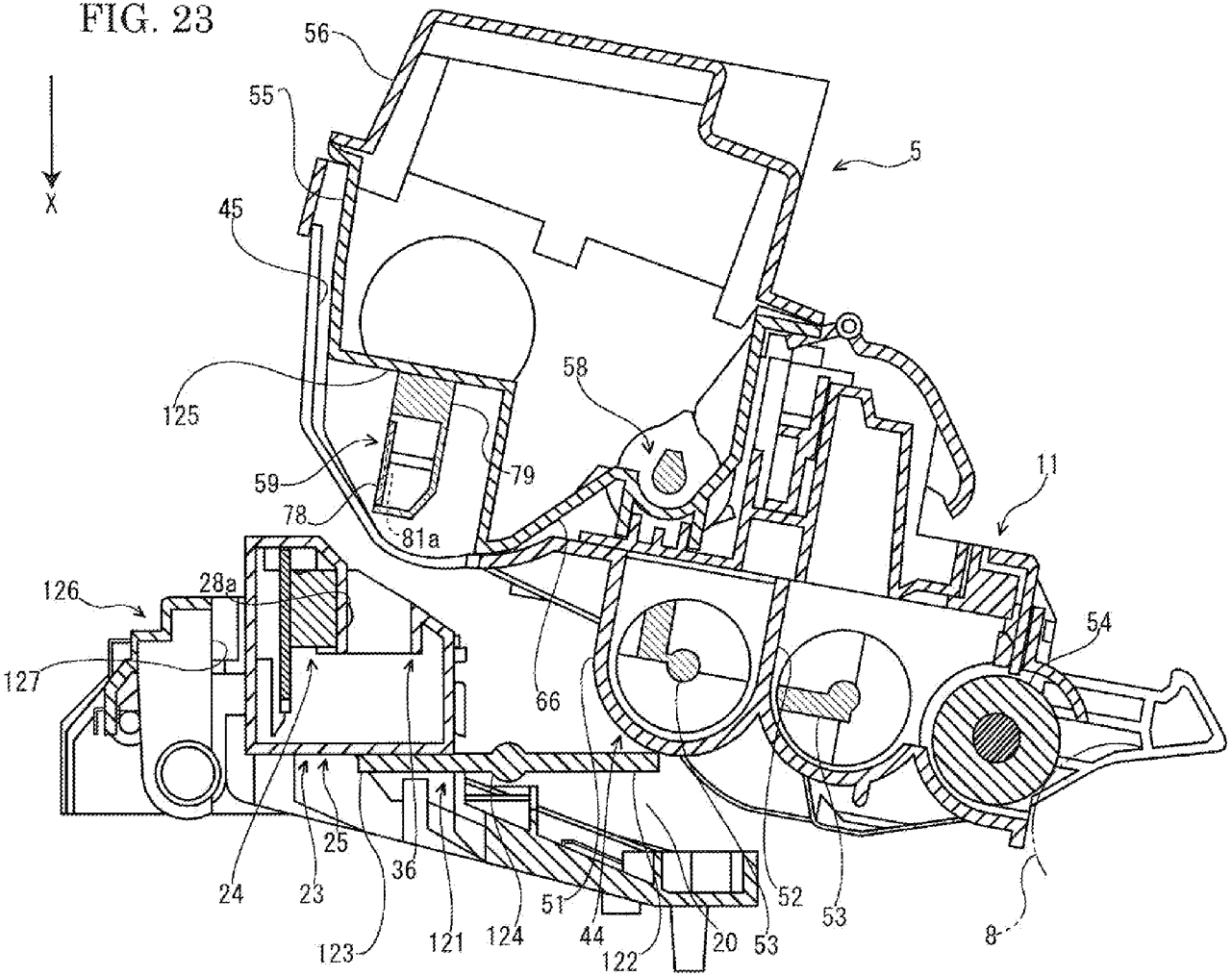
FIG. 23 is a sectional view showing the printer in a situation in the middle of attaching the development device to the installed part of the printer main body according to the fourth embodiment of the present disclosure.

In such a configuration as mentioned above, when the development device 11 is installed to the installed part 20 of the printer main body 2, as shown in FIG. 23, the development device 11 pressures the pressured part 122 of the swinging member 121. According to this, as shown in FIG. 22, the swinging member 121 swings around the fulcrum part 124 and, the pressuring part 123 of the swinging member 121 pressures the main body side connecting part 23, and then, the main body side connecting part 23 is moved upward (to the near side in the second direction X). According to this, the case side housing 79 fits to the fitting cylinder part 36 of the main body side housing 25 and the case side terminals 81*a*-81*d* come into contact with the main body side terminals 28*a*-28*d*.

By applying such a configuration, it is possible to withdraw the main body side connecting part 23 to the lower side (to the far side in the second direction X) until the development device 11 is installed to the installed part 20. Therefore, since the main body side connecting part 23 hardly obstructs jam work (work of eliminating the sheet jammed inside the printer main body 2), it is possible to easily carry out the jam work. When the development device 11 is installed to the installed part 20, since the main body side connecting part 23 is moved upward (to the near side in the second direction X) to approach the case side connecting part 59, it is possible to fit the case side housing 79 to the fitting cylinder part 36 of the main body side housing 25 without greatly projecting the case side connecting part 59 downward (to the far side in the second direction X). According to this, it is possible to reduce section area of the toner container 5.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an apparatus main body including an image carrier carrying a toner image, and a main body side connecting part including a main body side connector having a main body side terminal and a main body side housing holding the main body side connector;

a development device attachably/detachably installed to the apparatus main body to supply a toner to the image carrier; and a toner case attachably/detachably installed to the development device to supply a toner to the development device and including a case side connecting part including a case side connector having a case side terminal contactable with the main body side terminal and a case side housing holding the case side connector, wherein the development device is configured to be movable in a first direction as an approach/separation direction to the image carrier in a situation in which the development device is installed to the apparatus main body, the case side housing fits to the main body side housing and the case side terminal comes into contact with the main body side terminal in a situation in which the development device is installed to the apparatus main body and the toner case is installed to the development device, wherein the development device includes a fitting part fitting to the main body side housing with a gap in the first direction.

2. The image forming apparatus according to claim 1, wherein the fitting part is configured to fit to the main body side housing with a gap in a third direction intersecting the first direction and a second direction as an attaching direction of the toner case to the development device.

3. The image forming apparatus according to claim 1, wherein the fitting part is configured to fit to the main body side housing without a gap in a third direction intersecting the first direction and a second direction as an attaching direction of the toner case to the development device.

4. The image forming apparatus according to claim 1, wherein the apparatus main body further includes a supporting member supporting the main body side connecting part in a movable state in the first direction.

5. The image forming apparatus according to claim 4, wherein the supporting member is configured to support the main body side connecting part in a movable state in a third direction intersecting the first direction and a second direction as an attaching direction of the toner case to the development device.

6. The image forming apparatus according to claim 4, wherein the supporting member is configured to support the main body side connecting part in a state that the movement in a third direction intersecting the first direction and a second direction as an attaching direction of the toner case to the development device is restricted.

7. The image forming apparatus according to claim 1, wherein the main body side connecting part is configured to be movable along a second direction as an attaching direction of the toner case to the development device, the apparatus main body further includes a biasing member biasing the main body side connecting part to a near side in the second direction.

8. The image forming apparatus according to claim 1, wherein the apparatus main body further includes a biasing body biasing the development device to a direction approaching the image carrier.

9. An image forming apparatus comprising:

an apparatus main body including an image carrier carrying a toner image, and a main body side connecting part including a main body side connector having a main body side terminal and a main body side housing holding the main body side connector;

a development device attachably/detachably installed to the apparatus main body to supply a toner to the image carrier; and a toner case attachably/detachably installed to the development device to supply a toner to the development device and including a case side connecting part including a case side connector having a case side terminal contactable with the main body side terminal and a case side housing holding the case side connector, wherein the development device is configured to be movable in a first direction as an approach/separation direction to the image carrier in a situation in which the development device is installed to the apparatus main body, the case side housing fits to the main body side housing and the case side terminal comes into contact with the main body side terminal in a situation in which the development device is installed to the apparatus main body and the toner case is installed to the development device, wherein the main body side connecting part is configured to be movable along a second direction as an attaching direction of the toner case to the development device, the apparatus main body further includes an installed part to which the development device is installed, and a swinging member, which includes a pressured part inserted in the installed part, a pressuring part located at a far side in the second direction of the main body side connecting part, and a fulcrum part arranged between the pressured part and pressuring part, configured to be swingable around the fulcrum part, when the development device is installed to the installed part, the development device pressures the pressured part and the swinging member swings around the fulcrum part, and then, the pressuring part pressures the main body side connecting part and the main body side connecting part is moved to the near side in the second direction.

10. A toner case arranged to an image forming apparatus including an apparatus main body and a development device, wherein the apparatus main body includes an image carrier carrying a toner image, and a main body side connecting part including a main body side connector having a main body side terminal and a main body side housing holding the main body side connector, the development device is attachably/detachably installed to the apparatus main body to supply a toner to the image carrier, the toner case is attachably/detachably installed to the development device to supply a toner to the development device and includes a case side connecting part including a case side connector having a case side terminal contactable with the main body side terminal and a case side housing holding the case side connector, and the development device is configured to be movable in a first direction as an approach/separation direction to the image carrier in a situation in which the development device is installed to the apparatus main body, the case side housing fits to the main body side housing and the case side terminal comes into contact with the main body side terminal in a situation in which the development device is installed to the apparatus main body and the toner case is installed to the development device, wherein the development device includes a fitting part fitting to the main body side housing with a gap in the first direction.

11. The toner case according to claim 10, wherein the fitting part is configured to fit to the main body side housing with a gap in a third direction intersecting the first direction and a second direction as an attaching direction of the toner case to the development device.

12. The toner case according to claim 10, wherein the fitting part is configured to fit to the main body side housing without a gap in a third direction intersecting the first direction and a second direction as an attaching direction of the toner case to the development device.

13. The toner case according to claim 10, wherein the apparatus main body further includes a supporting member supporting the main body side connecting part in a movable state in the first direction.

14. The toner case according to claim 13, wherein the supporting member is configured to support the main body side connecting part in a movable state in a third direction intersecting the first direction and a second direction as an attaching direction of the toner case to the development device.

15. The toner case according to claim 13, wherein the supporting member is configured to support the main body side connecting part in a state that the movement in a third direction intersecting the first direction and a second direction as an attaching direction of the toner case to the development device is restricted.

16. The toner case according to claim 10, wherein the main body side connecting part is configured to be movable along a second direction as an attaching direction of the toner case to the development device, the apparatus main body further includes a biasing member biasing the main body side connecting part to a near side in the second direction.

17. The toner case according to claim 10, wherein the main body side connecting part is configured to be movable along a second direction as an attaching direction of the toner case to the development device, the apparatus main body further includes an installed part to which the development device is installed, and a swinging member, which includes a pressured part inserted in the installed part, a pressuring part located at a far side in the second direction of the main body side connecting part, and a fulcrum part arranged between the pressured part and pressuring part, configured to be swingable around the fulcrum part, when the development device is installed to the installed part, the development device pressures the pressured part and the swinging member swings around the fulcrum part, and then, the pressuring part pressures the main body side connecting part and the main body side connecting part is moved to the near side in the second direction.

18. The toner case according to claim 10, wherein the apparatus main body further includes a biasing body biasing the development device to a direction approaching the image carrier.

* * * * *